US006037555A

United States Patent [19]

Castonguay et al.

[11] Patent Number: 6,037,555

[45] Date of Patent: Mar. 14, 2000

[54] ROTARY CONTACT CIRCUIT BREAKER VENTING ARRANGEMENT INCLUDING CURRENT TRANSFORMER

[75] Inventors: Roger N. Castonguay, Terryville; Dennis J. Doughty, Plainville; Dean A. Robarge, Southington; Dave S. Christensen, Sandy Hook; James L. Rosen, West Hartford; Randall L. Greenberg, Granby, all of Conn.; Stefan Kranz, Eutin, Germany; Mark Culler, Glastonbury; Thomas Papallo, Farmington, both of Conn.

[73] Assignee: General Electric Company, Schenectady, N.Y.

[21] Appl. No.: 09/225,988

[22] Filed: Jan. 5, 1999

[51] Int. Cl.[7] ..... H01H 9/02; H01H 33/02; H01F 27/02

[52] U.S. Cl. ..... 218/157; 200/306; 335/202; 336/60

[58] Field of Search ..... 200/306; 218/35, 218/99, 106, 155, 156, 157; 336/59, 60; 335/16, 147, 202; 337/250, 270–272, 328

[56] References Cited

U.S. PATENT DOCUMENTS

| | | | |
|---|---|---|---|
| D. 367,265 | 2/1996 | Yamagata et al. | D13/160 |
| 2,340,682 | 2/1944 | Powell | 218/25 |
| 2,719,203 | 9/1955 | Gelzheiser et al. | 218/151 |
| 2,937,254 | 5/1960 | Ericson | 337/11 |
| 3,158,717 | 11/1964 | Jencks et al. | 200/337 |
| 3,162,739 | 12/1964 | Klein et al. | 335/9 |
| 3,197,582 | 7/1965 | Norden | 200/50.1 |
| 3,307,002 | 2/1967 | Cooper | 387/116 |
| 3,517,356 | 6/1970 | Hanafusa | 335/16 |
| 3,631,369 | 12/1971 | Menocal | 337/110 |
| 3,803,455 | 4/1974 | Willard | 361/106 |
| 3,883,781 | 5/1975 | Cotton | 361/37 |
| 4,129,762 | 12/1978 | Bruchet | 200/401 |
| 4,144,513 | 3/1979 | Shafer et al. | 335/46 |
| 4,158,119 | 6/1979 | Krakik | 200/240 |
| 4,165,453 | 8/1979 | Hennemann | 200/401 |
| 4,166,988 | 9/1979 | Ciarcia et al. | 335/9 |
| 4,220,934 | 9/1980 | Wafer et al. | 335/16 |
| 4,255,732 | 3/1981 | Wafer et al. | 335/16 |
| 4,259,651 | 3/1981 | Yamat | 335/16 |
| 4,263,492 | 4/1981 | Maier et al. | 200/288 |
| 4,276,527 | 6/1981 | Gerbert-Gaillard et al. | 335/39 |
| 4,297,663 | 10/1981 | Seymour et al. | 335/20 |
| 4,301,342 | 11/1981 | Castonguay et al. | 200/400 |
| 4,360,852 | 11/1982 | Gilmore | 361/98 |
| 4,368,444 | 1/1983 | Preuss et al. | 335/166 |
| 4,375,021 | 2/1983 | Pardini et al. | 218/25 |
| 4,375,022 | 2/1983 | Daussin et al. | 218/43 |
| 4,376,270 | 3/1983 | Staffen | 335/21 |
| 4,383,146 | 5/1983 | Bur | 200/17 R |
| 4,392,036 | 7/1983 | Troebel et al. | 200/322 |
| 4,393,283 | 7/1983 | Masuda | 200/51.09 |
| 4,401,872 | 8/1983 | Boichot-Castagne et al. | 200/401 |
| 4,409,573 | 10/1983 | DiMarco et al. | 335/16 |
| 4,435,690 | 3/1984 | Link et al. | 335/37 |
| 4,467,297 | 8/1984 | Boichot-Castagne et al. | 335/8 |
| 4,468,645 | 8/1984 | Gerbert-Gaillard et al. | 335/42 |

(List continued on next page.)

FOREIGN PATENT DOCUMENTS

| | | |
|---|---|---|
| 897 691 | of 0000 | Belgium . |
| 819 008 | 12/1974 | Belgium . |
| 0 061 092 | 9/1982 | European Pat. Off. . |
| 0 064 906 | 11/1982 | European Pat. Off. . |
| 0 066 486 | 12/1982 | European Pat. Off. . |
| 0 076 719 | 4/1983 | European Pat. Off. . |

(List continued on next page.)

*Primary Examiner*—J. R. Scott
*Attorney, Agent, or Firm*—Cantor Colburn LLP; Carl B. Horton

[57] ABSTRACT

A rotary contact circuit breaker having a venting arrangement to vent gasses operated by a short circuit interruption to a location substantially above the load strap of the breaker whereby electrical components are not damaged by the gasses and ionized gasses from different phases are conveyed in discrete channels for a period exceeding the period during which ionization is present.

12 Claims, 25 Drawing Sheets

U.S. PATENT DOCUMENTS

| | | | |
|---|---|---|---|
| 4,470,027 | 9/1984 | Link et al. | 335/16 |
| 4,479,143 | 10/1984 | Watanabe et al. | 358/44 |
| 4,488,133 | 12/1984 | McClellan et al. | 335/16 |
| 4,492,941 | 1/1985 | Nagel | 335/13 |
| 4,541,032 | 9/1985 | Schwab | 361/600 |
| 4,546,224 | 10/1985 | Mostosi | 200/401 |
| 4,550,360 | 10/1985 | Dougherty | 361/93 |
| 4,562,419 | 12/1985 | Preuss et al. | 335/195 |
| 4,589,052 | 5/1986 | Dougherty | 361/94 |
| 4,595,812 | 6/1986 | Tamaru et al. | 200/307 |
| 4,611,187 | 9/1986 | Banfi | 335/16 |
| 4,612,430 | 9/1986 | Sloan et al. | 200/327 |
| 4,616,198 | 10/1986 | Pardini | 335/16 |
| 4,622,444 | 11/1986 | Kandatsu et al. | 200/303 |
| 4,631,625 | 12/1986 | Alexnader et al. | 361/94 |
| 4,642,431 | 2/1987 | Tedesco et al. | 200/401 |
| 4,644,438 | 2/1987 | Puccinelli et al. | 361/75 |
| 4,649,247 | 3/1987 | Preuss et al. | 200/244 |
| 4,658,322 | 4/1987 | Rivera | 361/37 |
| 4,672,501 | 6/1987 | Bilac et al. | 361/96 |
| 4,675,481 | 6/1987 | Markowski et al. | 218/1 |
| 4,682,264 | 7/1987 | Demeyer | 361/96 |
| 4,689,712 | 8/1987 | Demeyer | 361/96 |
| 4,694,373 | 9/1987 | Demeyer | 361/96 |
| 4,710,845 | 12/1987 | Demeyer | 361/96 |
| 4,717,985 | 1/1988 | Demeyer | 361/96 |
| 4,733,211 | 3/1988 | Castonguay et al. | 335/192 |
| 4,733,321 | 3/1988 | Lindeperg | 361/96 |
| 4,764,650 | 8/1988 | Bur et al. | 200/564 |
| 4,768,007 | 8/1988 | Mertz et al. | 335/202 |
| 4,780,786 | 10/1988 | Weynachter et al. | 361/87 |
| 4,831,221 | 5/1989 | Yu et al. | 200/553 |
| 4,870,531 | 9/1989 | Danek | 361/93.1 |
| 4,883,931 | 11/1989 | Batteux et al. | 218/14 |
| 4,884,047 | 11/1989 | Baginski et al. | 335/10 |
| 4,884,164 | 11/1989 | Dziura et al. | 361/97 |
| 4,900,882 | 2/1990 | Bernard et al. | 218/26 |
| 4,910,485 | 3/1990 | Bolongeat-Mobleu et al. | 335/195 |
| 4,914,541 | 4/1990 | Tripodi et al. | 361/94 |
| 4,916,420 | 4/1990 | Bartolo et al. | 335/172 |
| 4,916,421 | 4/1990 | Pardini et al. | 335/185 |
| 4,926,282 | 5/1990 | McGhie | 361/102 |
| 4,935,590 | 6/1990 | Malkin et al. | 218/57 |
| 4,937,706 | 6/1990 | Schueller et al. | 361/744 |
| 4,939,492 | 7/1990 | Raso et al. | 335/42 |
| 4,943,691 | 7/1990 | Mertz et al. | 218/117 |
| 4,943,888 | 7/1990 | Jacob et al. | 361/96 |
| 4,950,855 | 8/1990 | Bolonegeat-Mobleu et al. | 218/66 |
| 4,951,019 | 8/1990 | Gula | 335/166 |
| 4,952,897 | 8/1990 | Barnel et al. | 335/147 |
| 4,958,135 | 9/1990 | Baginski et al. | 335/8 |
| 4,965,543 | 10/1990 | Batteux | 335/174 |
| 4,983,788 | 1/1991 | Pardini | 200/16 R |
| 5,001,313 | 3/1991 | Leclerq et al. | 218/76 |
| 5,004,878 | 4/1991 | Seymour et al. | 218/155 |
| 5,029,301 | 7/1991 | Nebon et al. | 335/16 |
| 5,030,804 | 7/1991 | Abri | 200/323 |
| 5,057,655 | 10/1991 | Kersusan et al. | 218/76 |
| 5,077,627 | 12/1991 | Fraisse | 361/93.2 |
| 5,083,081 | 1/1992 | Barrault et al. | 324/126 |
| 5,095,183 | 3/1992 | Raphard et al. | 218/54 |
| 5,103,198 | 4/1992 | Morel et al. | 335/6 |
| 5,115,371 | 5/1992 | Tripodi | 361/106 |
| 5,120,921 | 6/1992 | DiMarco et al. | 200/401 |
| 5,121,092 | 6/1992 | Castonguay et al. | 335/172 |
| 5,132,865 | 7/1992 | Mertz et al. | 361/6 |
| 5,138,121 | 8/1992 | Streich et al. | 200/293 |
| 5,140,115 | 8/1992 | Morris | 200/308 |
| 5,146,195 | 9/1992 | Castonguay et al. | 335/35 |
| 5,153,802 | 10/1992 | Mertz et al. | 361/18 |
| 5,155,315 | 10/1992 | Malkin et al. | 218/3 |
| 5,166,483 | 11/1992 | Kersusan et al. | 218/71 |
| 5,172,087 | 12/1992 | Castonguay et al. | 335/160 |
| 5,178,504 | 1/1993 | Falchi | 411/553 |
| 5,184,717 | 2/1993 | Chou et al. | 200/401 |
| 5,187,339 | 2/1993 | Lissandrin | 218/84 |
| 5,198,956 | 3/1993 | Dvorak | 361/106 |
| 5,200,724 | 4/1993 | Gula et al. | 335/166 |
| 5,210,385 | 5/1993 | Morel et al. | 218/9 |
| 5,239,150 | 8/1993 | Bolongeat-Mobleu et al. | 218/84 |
| 5,260,533 | 11/1993 | Livesey et al. | 200/401 |
| 5,262,744 | 11/1993 | Arnold et al. | 335/8 |
| 5,280,144 | 1/1994 | Bolongeat-Mobleu et al. | 218/70 |
| 5,281,776 | 1/1994 | Morel et al. | 218/152 |
| 5,296,660 | 3/1994 | Morel et al. | 218/20 |
| 5,296,664 | 3/1994 | Crookston et al. | 200/401 |
| 5,298,874 | 3/1994 | Morel et al. | 335/8 |
| 5,300,907 | 4/1994 | Nereau et al. | 335/172 |
| 5,310,971 | 5/1994 | Vial et al. | 200/244 |
| 5,313,180 | 5/1994 | Vial et al. | 335/16 |
| 5,317,471 | 5/1994 | Izoard et al. | 361/105 |
| 5,331,500 | 7/1994 | Corcoles et al. | 361/93.3 |
| 5,334,808 | 8/1994 | Bur et al. | 200/50.21 |
| 5,341,191 | 8/1994 | Crookston et al. | 335/16 |
| 5,347,096 | 9/1994 | Bolongeat-Mobleu et al. | 218/84 |
| 5,347,097 | 9/1994 | Bolongeat-Mobleu et al. | 218/76 |
| 5,350,892 | 9/1994 | Rozier | 218/119 |
| 5,357,066 | 10/1994 | Morel et al. | 200/17 R |
| 5,357,068 | 10/1994 | Rozier | 218/44 |
| 5,357,394 | 10/1994 | Piney | 361/72 |
| 5,361,052 | 11/1994 | Ferullo et al. | 335/172 |
| 5,373,130 | 12/1994 | Barrault et al. | 218/30 |
| 5,379,013 | 1/1995 | Coudert | 335/17 |
| 5,381,120 | 1/1995 | Arnold et al. | 335/35 |
| 5,392,016 | 2/1995 | Arnold et al. | 335/176 |
| 5,424,701 | 6/1995 | Castonguary et al. | 335/172 |
| 5,438,176 | 8/1995 | Bonnardel et al. | 200/400 |
| 5,440,088 | 8/1995 | Coudert et al. | 200/303 |
| 5,449,871 | 9/1995 | Batteux et al. | 200/401 |
| 5,450,048 | 9/1995 | Leger et al. | 335/132 |
| 5,451,729 | 9/1995 | Onderka et al. | 200/18 |
| 5,457,295 | 10/1995 | Tanibe et al. | 200/293 |
| 5,467,069 | 11/1995 | Payet-Burin et al. | 335/42 |
| 5,469,121 | 11/1995 | Payet-Burin | 335/16 |
| 5,475,558 | 12/1995 | Barjonnet et al. | 361/64 |
| 5,477,016 | 12/1995 | Baginski et al. | 200/43.11 |
| 5,479,143 | 12/1995 | Payet-Burin | 335/202 |
| 5,483,212 | 1/1996 | Lankuttis et al. | 335/132 |
| 5,485,343 | 1/1996 | Santos et al. | 361/115 |
| 5,493,083 | 2/1996 | Olivier | 200/17 R |
| 5,504,284 | 4/1996 | Lazareth et al. | 200/50.01 |
| 5,504,290 | 4/1996 | Baginski et al. | 200/401 |
| 5,510,761 | 4/1996 | Boder et al. | 335/172 |
| 5,512,720 | 4/1996 | Coudert et al. | 200/400 |
| 5,515,018 | 5/1996 | DiMarco et al. | 335/16 |
| 5,519,561 | 5/1996 | Mrenna et al. | 361/105 |
| 5,534,674 | 7/1996 | Steffens | 218/154 |
| 5,534,832 | 7/1996 | Duchemin et al. | 335/16 |
| 5,534,835 | 7/1996 | McColloch et al. | 335/172 |
| 5,534,840 | 7/1996 | Cuingnet | 337/1 |
| 5,539,168 | 7/1996 | Linzenich | 200/303 |
| 5,543,595 | 8/1996 | Mader et al. | 200/401 |
| 5,552,755 | 9/1996 | Fello et al. | 335/18 |
| 5,581,219 | 12/1996 | Nozawa et al. | 335/132 |
| 5,604,656 | 2/1997 | Derrick et al. | 361/187 |
| 5,608,367 | 3/1997 | Zoller et al. | 335/132 |
| 5,784,233 | 7/1998 | Bastard et al. | 361/36 |

FOREIGN PATENT DOCUMENTS

| | | |
|---|---|---|
| 0 140 761 | 5/1985 | European Pat. Off. . |
| 0 174 904 | 3/1986 | European Pat. Off. . |
| 0 196 241 | 10/1986 | European Pat. Off. . |

| | | |
|---|---|---|
| 0 224 396 | 6/1987 | European Pat. Off. . |
| 0 235 479 | 9/1987 | European Pat. Off. . |
| 0 239 460 | 9/1987 | European Pat. Off. . |
| 0 258 090 | 3/1988 | European Pat. Off. . |
| 0 264 313 | 4/1988 | European Pat. Off. . |
| 0 264 314 | 4/1988 | European Pat. Off. . |
| 0 283 189 | 9/1988 | European Pat. Off. . |
| 0 283 358 | 9/1988 | European Pat. Off. . |
| 0 291 374 | 11/1988 | European Pat. Off. . |
| 0 295 155 | 12/1988 | European Pat. Off. . |
| 0 95 158 | 12/1988 | European Pat. Off. . |
| 0 309 923 | 4/1989 | European Pat. Off. . |
| 0 313 106 | 4/1989 | European Pat. Off. . |
| 0 313 422 | 4/1989 | European Pat. Off. . |
| 0 314 540 | 5/1989 | European Pat. Off. . |
| 0 331 586 | 9/1989 | European Pat. Off. . |
| 0 337 900 | 10/1989 | European Pat. Off. . |
| 0 342 133 | 11/1989 | European Pat. Off. . |
| 0 367 690 | 5/1990 | European Pat. Off. . |
| 0 371 887 | 6/1990 | European Pat. Off. . |
| 0 375 568 | 6/1990 | European Pat. Off. . |
| 0 394 144 | 10/1990 | European Pat. Off. . |
| 0 394 922 | 10/1990 | European Pat. Off. . |
| 0 399 282 | 11/1990 | European Pat. Off. . |
| 0 407 310 | 1/1991 | European Pat. Off. . |
| 0 452 230 | 10/1991 | European Pat. Off. . |
| 0 555 158 | 8/1993 | European Pat. Off. . |
| 0 567 416 | 10/1993 | European Pat. Off. . |
| 0 595 730 | 5/1994 | European Pat. Off. . |
| 0 117 094 | 8/1994 | European Pat. Off. . |
| 0 619 591 | 10/1994 | European Pat. Off. . |
| 0 665 569 | 8/1995 | European Pat. Off. . |
| 0 700 140 | 3/1996 | European Pat. Off. . |
| 2 410 353 | 6/1979 | France . |
| 2 512 582 | 3/1983 | France . |
| 2 553 943 | 4/1985 | France . |
| 2 592 998 | 7/1987 | France . |
| 2 682 531 | 4/1993 | France . |
| 2 697 670 | 5/1994 | France . |
| 2 699 324 | 6/1994 | France . |
| 2 714 771 | 7/1995 | France . |
| 12 27 978 | 11/1966 | Germany . |
| 30 47 360 | 6/1982 | Germany . |
| 38 02 184 | 8/1989 | Germany . |
| 38 43 277 | 6/1990 | Germany . |
| 44 19 240 | 1/1995 | Germany . |
| 1 227 978 | of 0000 | Russian Federation . |
| 2 233 155 | 1/1991 | United Kingdom . |
| 92/00598 | 1/1992 | WIPO . |
| 92/05649 | 4/1992 | WIPO . |
| 94/00901 | 1/1994 | WIPO . |

ROTARY CONTACT CIRCUIT BREAKER VENTING ARRANGEMENT INCLUDING CURRENT TRANSFORMER

BACKGROUND OF THE INVENTION

Field of the Invention

The invention relates to rotary contact circuit breakers. More particularly, the invention relates to the exhausting of gasses generated within the circuit breaker by a short circuit interruption.

In all circuit breakers, the separation of the contacts due to a short circuit causes an electrical arc to form between the separating contacts. The arc causes the formation of relatively high pressure gasses as well as ionization of air molecules within the arc chamber of the circuit breaker. The gasses are hot and deleterious to electrical components. Moreover, the ionized gasses are highly volatile and ignitable upon intermixing with ionized gasses from different electrical phases. The gasses, therefore, must be kept separate until the ionization has dissipated and temperature of the gasses has moderated. An exhaust port is conventionally employed to vent such gasses in a rotary contact circuit breaker, each pole or phase employs two sets of contacts, two contacts of which rotate about a common axis generally perpendicular to the current path from the line side to the load side of the circuit breaker. Each contact set in such an arrangement requires an exhaust port to expel gasses. One of the exhaust ports will be on the line side and one of the exhaust ports will be on the load side of the breaker. In conventional units the exhaust port on the line side is located near the top of the beaker. Since gasses naturally flow in the direction of this port on the line side of the breaker, the port is effective. On the load side of the circuit breaker, the gasses formed consequent to a short circuit naturally migrate toward the lower corner of the breaker. Thus, it is axiomatic that an exhaust port is located at this corner providing there is sufficient room to exhaust gasses from this port.

Regulatory agencies such as UL and IEC promulgate rules that govern many parameters such as through-air and over-surface clearances. Because of these rules and the properties that caused the adoption of these rules, exhausting of gasses on the load side of the circuit breaker becomes more difficult. The art, then, is in need of an exhaust system for more tightly constructed circuit breakers.

SUMMARY OF THE INVENTION

The above-described and other disadvantages of the prior art are alleviated by the exhaust gas venting arrangement of the invention.

A venting arrangement is created by providing cooperating cavities (when assembled) with a base, midcover, cassettes, current transformer (or thermomag) housing and spacers which provide a series of channels for routing ionized gasses independently of one another to an appropriate outlet. The venting arrangement of the invention conveys the gasses without damaging other components of the circuit breaker. Moreover, the arrangement maximizes venting volume and allows for minimization of the overall size of the circuit breaker.

BRIEF DESCRIPTION OF THE DRAWINGS

Referring now to the drawings wherein like elements are numbered alike in the several FIGURES.

DETAILED DESCRIPTION OF THE PREFERRED EMBODIMENTS

Figure 1:
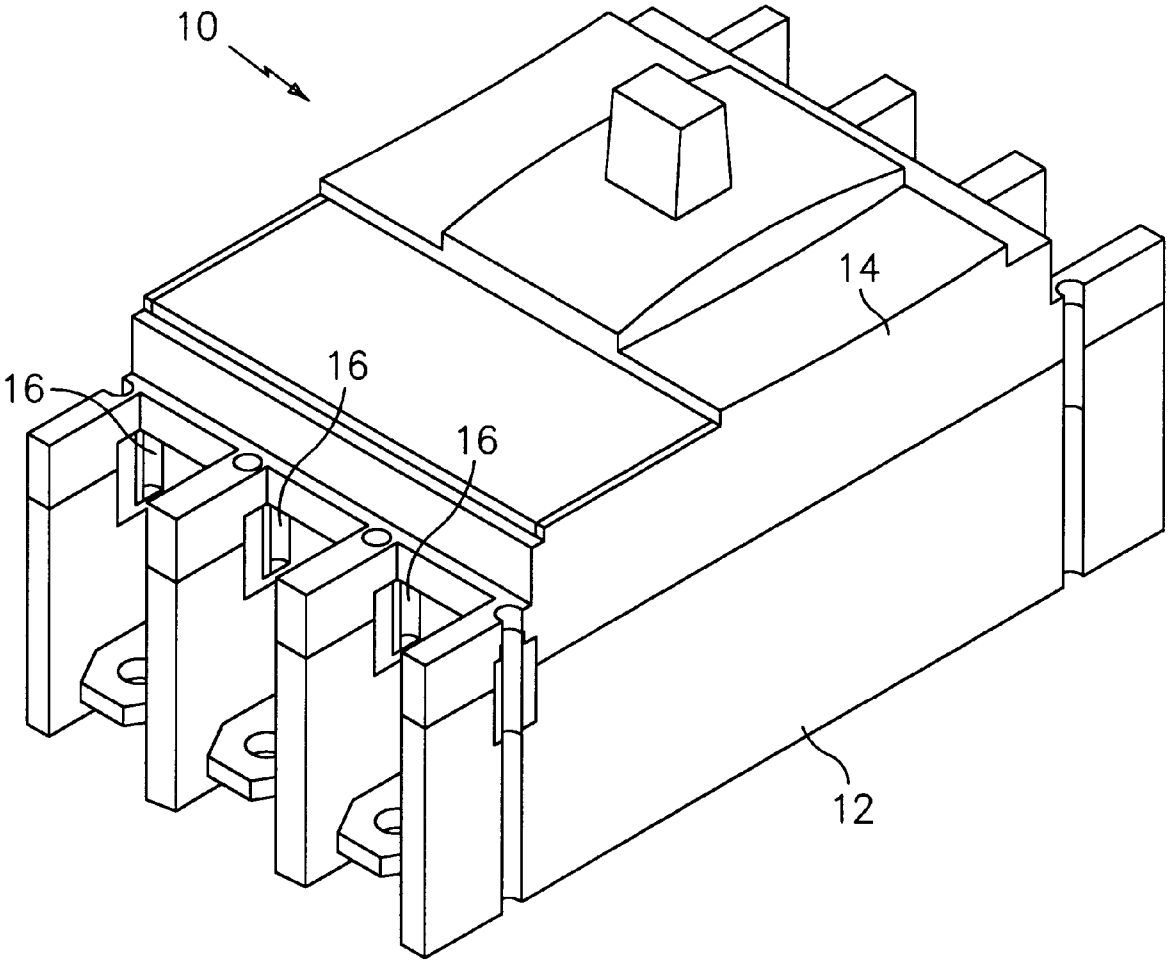
FIG. 1 is a perspective view of one embodiment of the circuit breaker of the invention.

Referring to FIG. 1, a first embodiment of the invention is illustrated in perspective assembled form. The entire device is referred to as 10 herein. Exterior features include a base 12 which provides support for and protection to the internal components discussed hereunder. Midcover 14 is dimensioned and shaped to reside atop base 12 and as an extension thereof and to cover the internal components. It should be noted that load side vent ports 16 are visible in FIG. 1. In order to provide a better detailed description of the components shown in FIG. 1, reference is made to the exploded view of FIG. 2.

Base 12 includes bottom wall 20 and side walls 22 defining an interior cavity adapted to receive and support a plurality of internal electrical components. The adaptation in general will include locating tangs and stiffening ribs. In the embodiment shown, locating tangs 24 are visible extending upwardly from bottom wall 20 and in line with stiffening ribs 26. Ribs 26 preferably include shoulder 28 at a height from bottom 20 equivalent to the extent of location tangs 24 to effectively provide a support surface for the internal electrical components. Extending from the line side of the base 12 are line strap spacers 30. Preferably for this embodiment, two spacers 30 are provided at equal intervals between side walls 22 to divide the space between the side walls into three equal segments. It should be noted that more spacers 30 could be used with a greater spacing between sidewalls 22 to create more segments for additional poles in the circuit breaker if desired. Each spacer 30 includes a through bore 32 for mounting purposes. A groove 34 is also provided in sidewalls 22 to complement through bore 32 and is also for mounting purposes. Extending from bottom 20 at the line side edge of base 12 are stub walls 36 which support spacers 30 and protect internal components of circuit breaker 10.

At the load side of base 12, the space between sidewalls 22 is divided into segments equivalent to the segments at the line side of base 12. The segments are created by partitions 40 supported by partition supports 42 which extend from bottom 20 and from partition to partition. Partitions 40 are complemented by sidewall extensions 44 (are on each side of base 12) which each provide a groove 46 for mounting circuit breaker 10 and similar features to partitions 40 for interconnection with internal components. The features of partitions 40 and sidewall extensions 44 that interconnect with internal components and particularly the gas exhaust structures (discussed hereunder) are flange groove 48 which is identical among partitions and sidewall extensions and hollow 50. Groove 48 is preferably a ninety degree extended groove that receives a flange in the exhaust structures. Hollow 50 is a recess in each partition 40 and sidewall extension 44 to further locate and stabilize the internal structures.

Before discussion of the internal structures of the circuit breaker, it is well to discuss the midcover 60 of the housing for clarity of what contains the components of the circuit breaker. Midcover 60 fits flush to the outside with sidewalls 22 of base 12 and flush with individual partitions 40, spacers 30 sidewall extensions 44 and sideback extensions 31 with, respectively, partition caps 62, spacer caps 64, sidewall extension caps 66 and sideback extension caps 68. Bores 70 are for mounting the circuit breaker 10 to a support (not shown).

Figure 2:
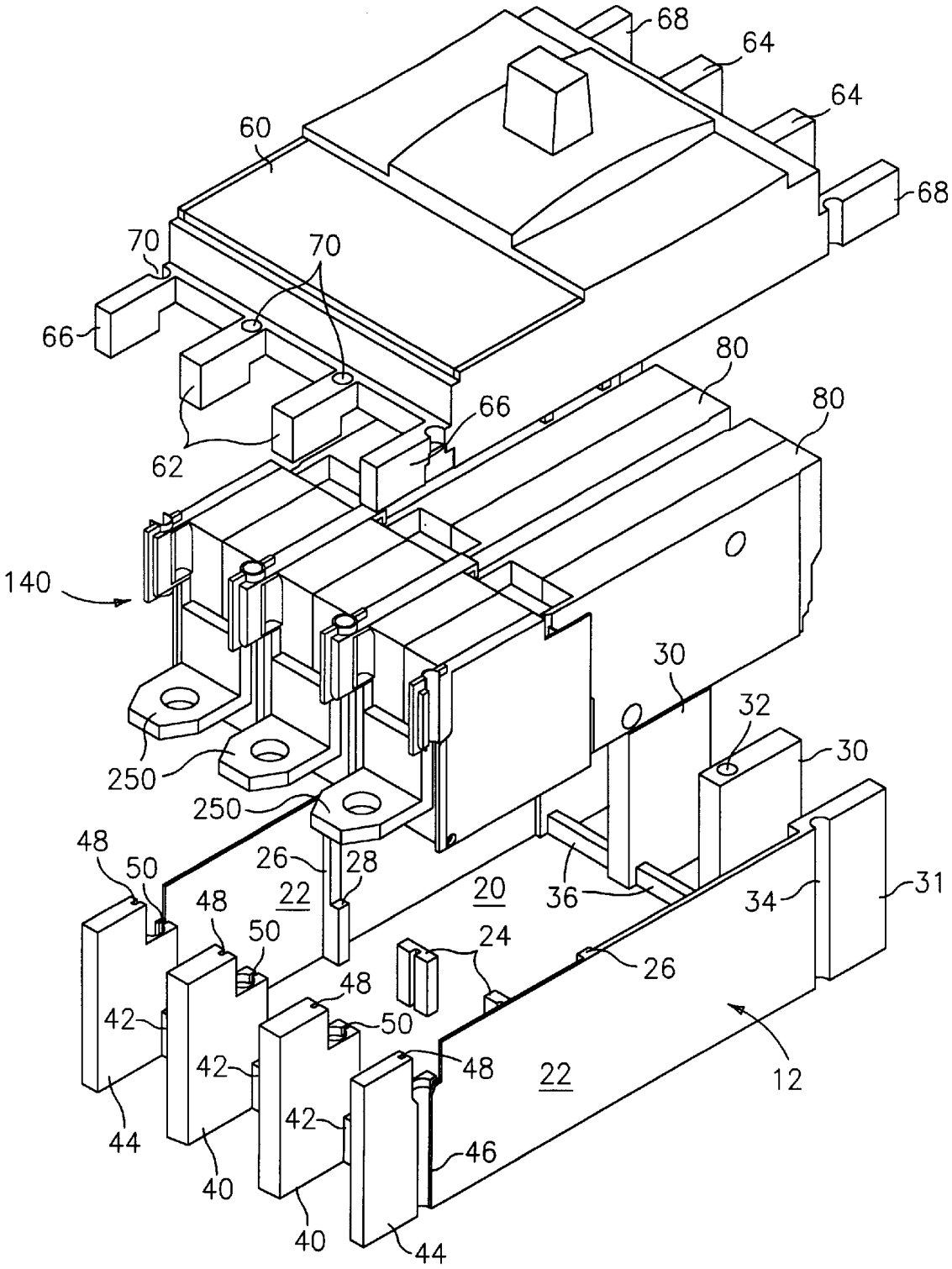
FIG. 2 is an exploded perspective view of the circuit breaker of FIG. 1 illustrating components in an assembled condition.

With continuing reference to FIG. 2, a broad, initial, discussion of the internal components of the device of the invention may be had. The breaker comprises a plurality of cassette assemblies 80 each connected to one current transformer of a block of current transformers 140. The individual cassettes each include a load strap 150 each of which is attached through a current transformer. The cassettes 80 and the current transformer block 140 together, in addition to providing the conventional electrical function, also provide gas exhaust pathways for each rotary contact breaker cassette.

Figure 3:
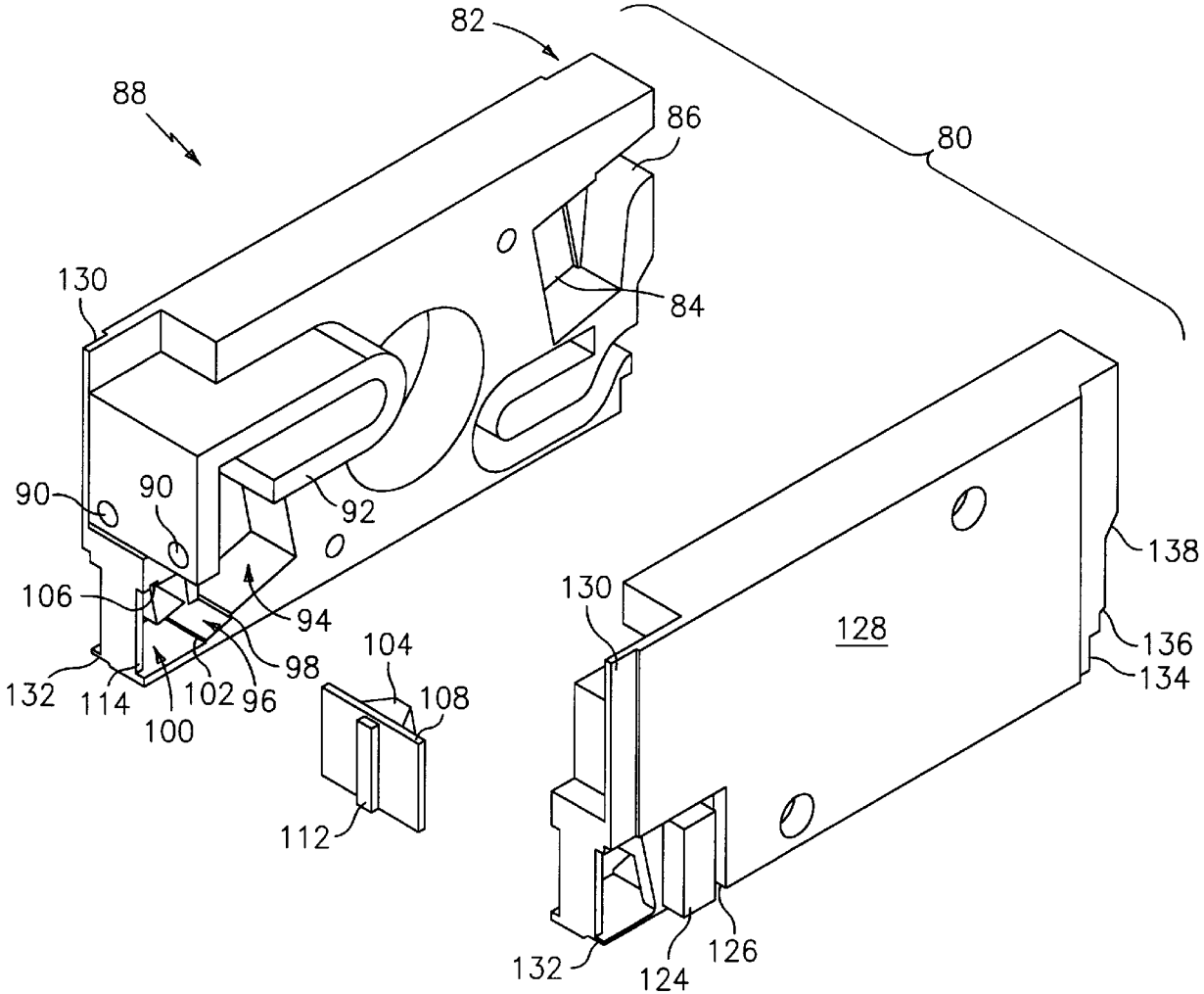
FIG. 3 is an exploded perspective view of a cassette of the invention.

Considering the individual internal components in greater detail, reference is made to FIG. 3. It should be appreciated that since the invention is specifically directed only to exhaust gas pathway parts of the cassette, only parts relevant to this function are illustrated. It is within the level of skill of one of ordinary skill in the art to understand how to make and use the conventional (not discussed or shown) portions of the circuit breaker cassette. The cassette 80 is illustrated in FIG. 3 in an exploded perspective view to provide an understanding of the gas pathways presented at the line side 82 of the cassette, one of skill in the art will appreciate that the gas expansion area 84 is directly above the area where a contact is made (contacts not shown). Vent 86 is easily positioned in a location very conducive to exhausting the gasses. At the load side 88, however, it is apparent that gasses are not provided a simple and efficacious escape route. Thus, a route is provided by the invention. The gas expansion area opens from the contact area under contact 92. The expansion area provides (see FIG. 5) a generally rectangular area 94 which opens to a trapezoidal area 96 which steps downward from area 94 at step 98. Adjacent trapezoidal area 96 is diverter recess 100 including diverter step 102 which is provided to help locate diverter 104 in recess 100. The proper location of diverter 104 provides a beneficial and effective exhaust gas path. Diverter recess 100 further includes a slot 106 to receive a top edge of diverter 104. As can be appreciated from FIG. 3, diverter 104 will slide laterally into the recess 100 with a top edge 108 of diverter 104 in slot 106 and a toe 110 (see FIGS. 4 and 5) of diverter 104 in contact with diverter step 102 until diverter stop 112 comes into contact with stop recess wall 114. It should be appreciated that all of the features described on what is the left side of the cassette in FIG. 3 are mirrored on the right side of the cassette.

Figure 4:
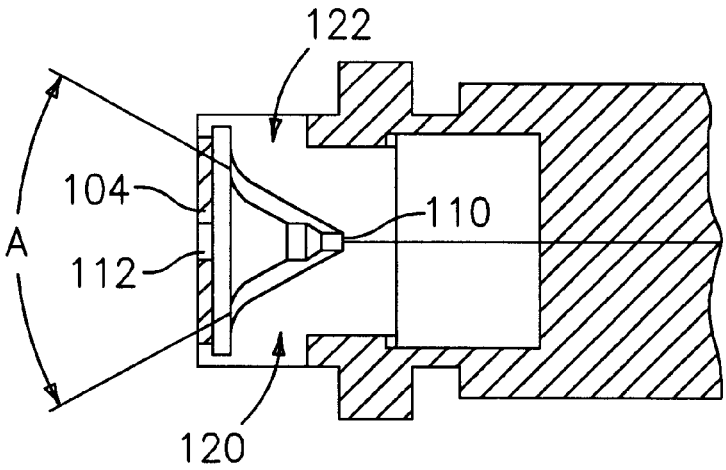
FIG. 4 is a partial cross section assembled view of the components in FIG. 5 taken along section line 4—4.
Figure 5:
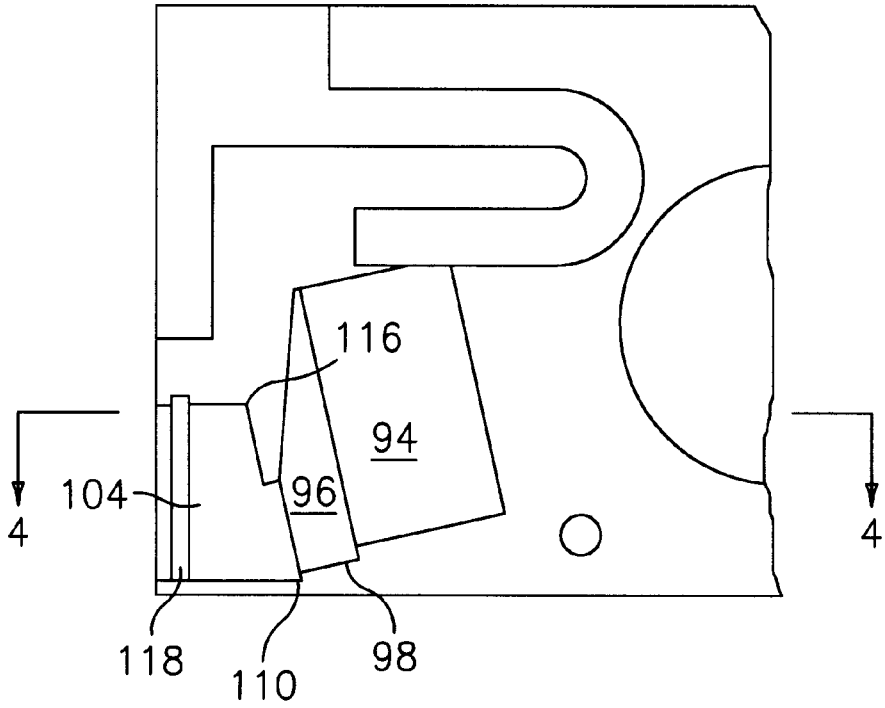
FIG. 5 is a partial cross section view of a cassette of the invention.

Referring to FIGS. 4 and 5, one will appreciate the shape of diverter 104. Diverter 104 is less thick at the head 116 and more thick at the toe 110 when viewed relative to seal wall 118. This creates a passage dimension, when combined with cassette 80, that is effective in conveying exhaust gas. Exhaust exits 120 and 122 from cassette 80 are shown in FIG. 4.

Referring again to FIG. 3, and to facilitate fluid conveying attachment to current transformer block 140, cassette 80 is provided on both sides thereof with gas shutoff 124 which resides in connection recess 126 extending inwardly from sidewall 128 of cassette 80. These features are mirrored in the opposite sidewall of cassette 80 and provide an interlocking arrangement with a mating vent channel in the current transformers. The gas shutoff and its mating channel provide the required over surface and through-air clearance required by the UL standard. Cassette 80 further provides a vent recess 130 which allows an overlapped attachment to vent structures within the current transformer block 140.

Finally, still referring to FIG. 3, each cassette 80 is provided with groove 132 for overlapping with the CT housing to provide over surface clearances and notches 134, 136 and 138 for clearance with base.

Figure 6:
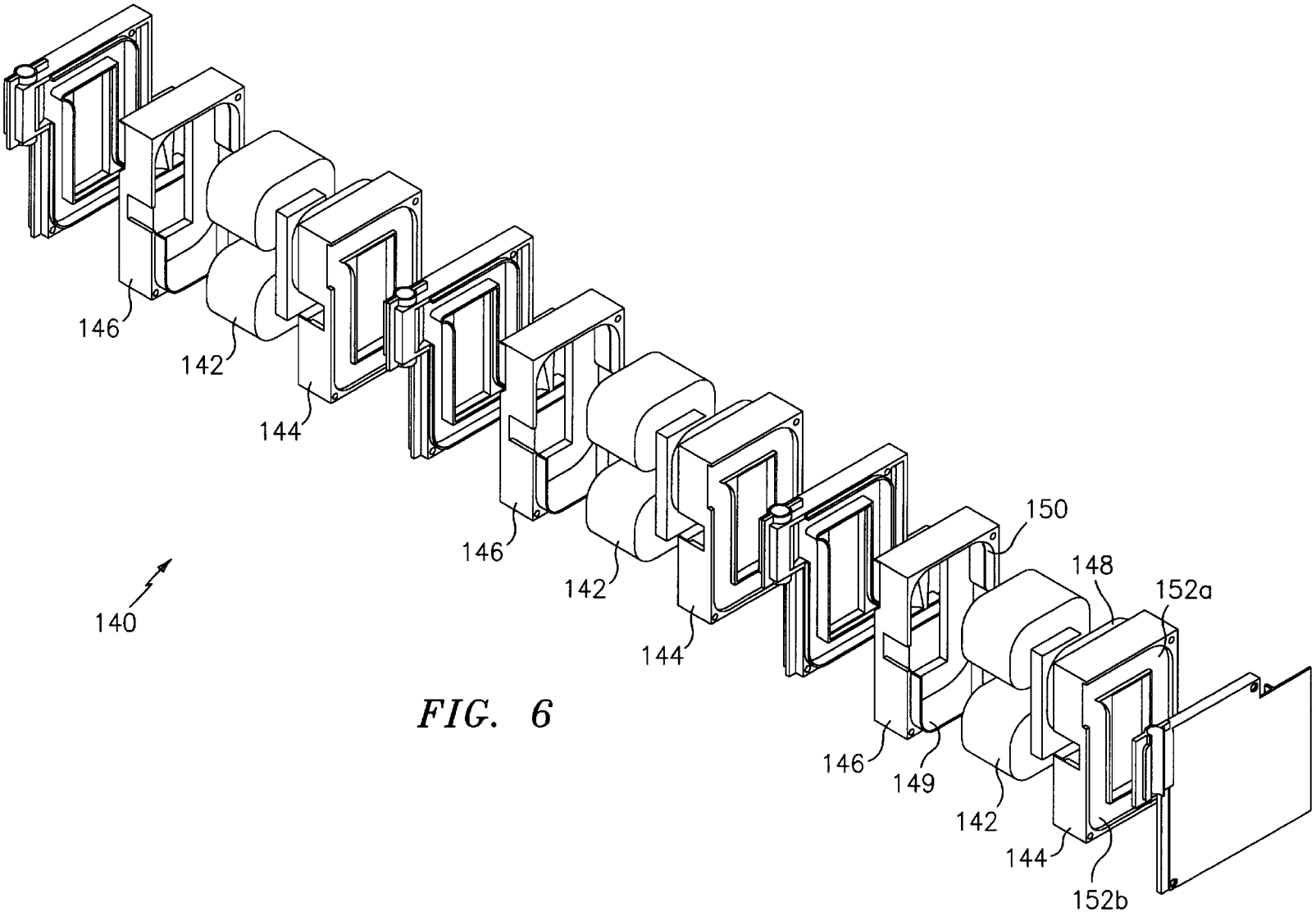
FIG. 6 is an exploded perspective view of a group of three current transformers with housing, vent channels and end vent channels illustrated.
Figure 7:
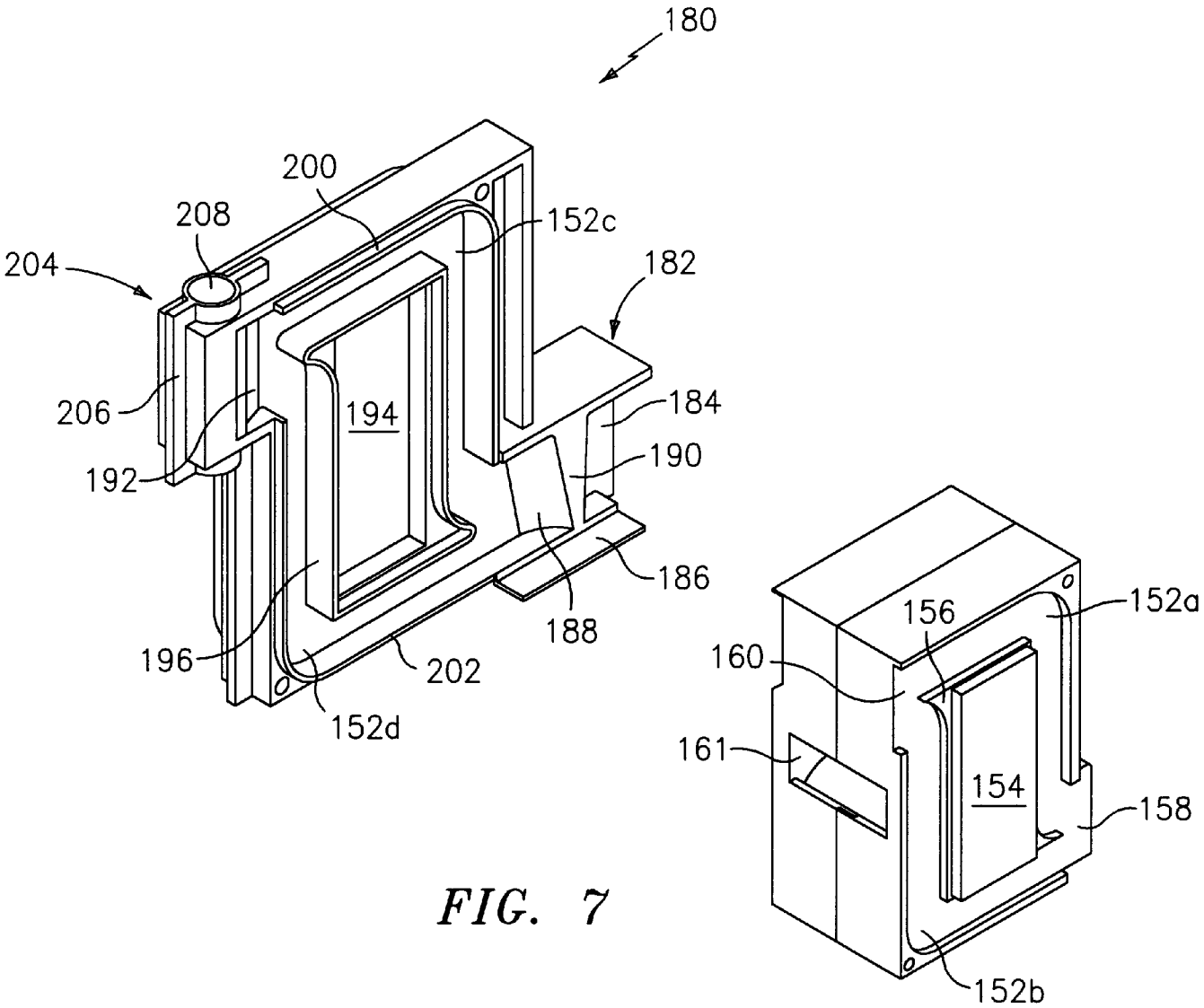
FIG. 7 is semi-exploded perspective view of a current transformer within its housing and a vent channel.
Figure 8:
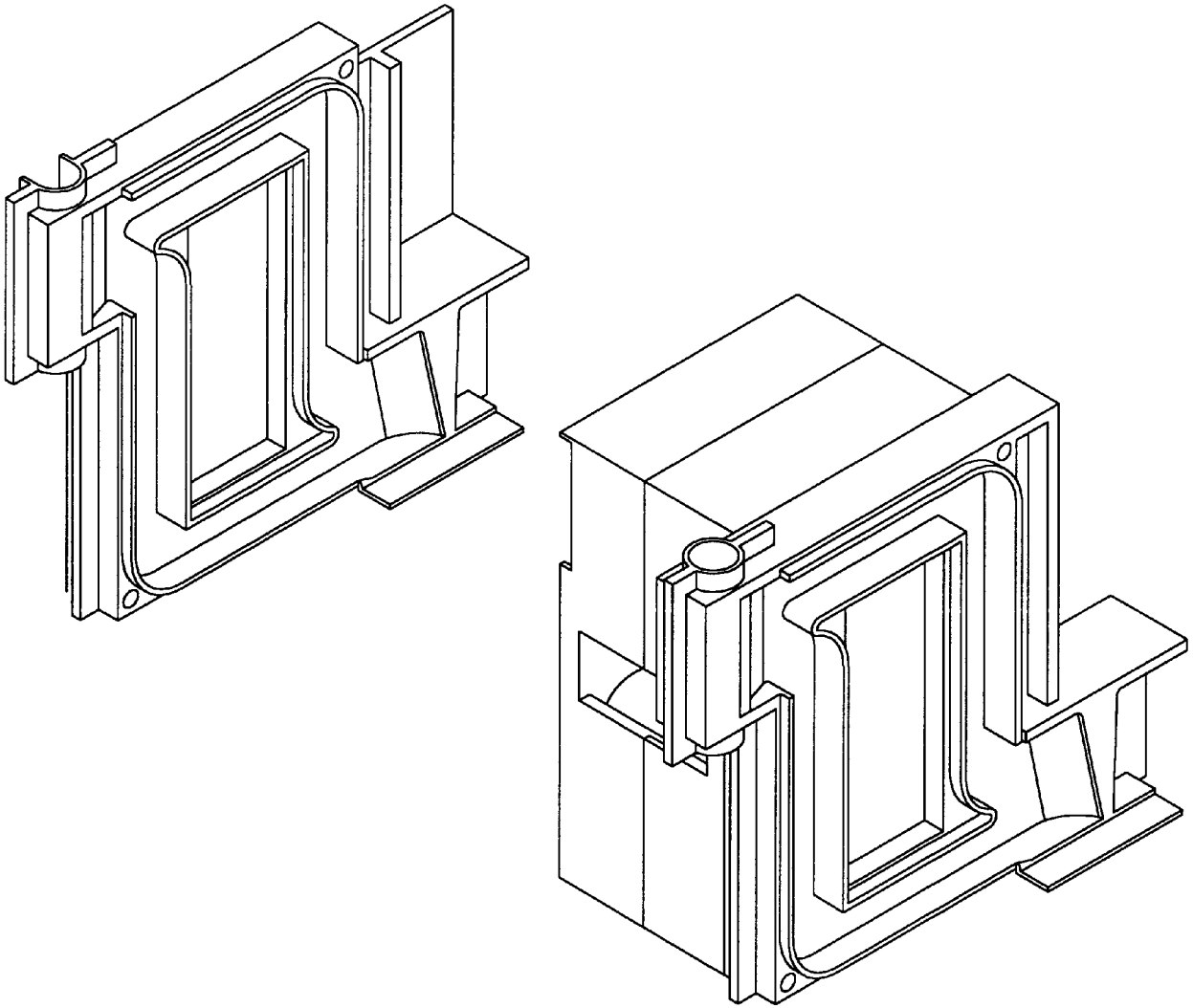
FIG. 8 is semi-exploded perspective view of a current transformer as in FIG. 7 but with a second vent channel added on the housing.

Turning now to current transformer block 140 and FIGS. 6 and 7, one of ordinary skill in the art will ascertain from the drawing that in the illustrated embodiment, three current transformers 142 are employed; fewer or more could be employed depending upon desired number of poles. Current transformers 142 are conventional units and are commercially available. Each current transformer (CT) 142 is enclosed in a housing having distinct first and second sides. Housing side 144 is illustrated on the right side of each CT 142 in drawing FIG. 6 and housing side 146 on the left. The housing sides together form an opening 161 for through passage of a contact strap discussed hereunder. Referring to the interior sections of the housing sides first, one will note that side 144 has an upper lip 148 which is receivable in housing side 146 in recess 150 and side 146 includes lower lip 149 which conversely to lip 148 is receivable in side 144. The lips 148 and 152 (a, b, c, d) assist to reliably attach the two housing sides together and are conventional features. All other internal features of housing sides 144 and 146 are also conventional and do not require discussion. Exterior features of each of the housing sides 144 and 146 however provide significant advantages in accordance with the invention.

Externally to each housing side, referring to FIGS. 6 and 7, is a depressed path 152 divided into paths 152*a* and 152*b* which join at each end of the paths. The paths 152*a* and 152*b* are enclosed upon attachment of vent structure 180 one of which is preferably located on each side of assembled housing sides 144 and 146. Housing side 144 and 146 provide location lug 154 and bifurcation lug 156 both of which aid in attachment of vent structure 180. It should be noted that depression 152*a*/152*b* continues to inlet 158 and outlet 160. Focusing on vent structure 180 (FIG. 7), connector member 182 includes several features adapted to connect the structure 180 to a cassette 80. As shutoff recess 184 receives gas shutoff 124, wall 190 blocks gas escape from rearwardly of the pathway and tang 186 is received in groove 132. Bifurcated pathways 152*c* and 152*d* mate with pathways 152*a* and 152*b* respectively to form the centrally bifurcated exhaust gas conduit 152 the ends of which are radiused, see 188 at the inlet side of 192 at the outlet side (which culminates at port 16). Locating recess 194 communicates with location lug 154 and bifurcation 196 nests with bifurcation lug 156 when the vent structure 180 is attached to CT housing side 144 or 146. To help seal the pathway 152, upper pathway lip 200 and lower pathway lip 202 are provided on vent structure 180 and rest within the edges of depression 152*a* and 152*b*, respectively. Vent structure 180 finally includes base-midcover mating structure 204 which includes flange 206 for reception in groove 48 upon assembly of the device 10. Bore 208 provides for through passage of circuit breaker mounting screws.

It should be noted that vent structures meant to be employed between two current transformers include the above discussed features on both sides whereas vent structures meant to be used on an end of the CT block 140 have such structures on one side.

As one should appreciate, preferably as many current transformers as cassettes will be employed with vent structures therebetween as shown. The vent structures provide segregated pathways cassette-to-cassette to avoid mixing ionized exhaust gas until the ionization has diminished.

Figure 9:
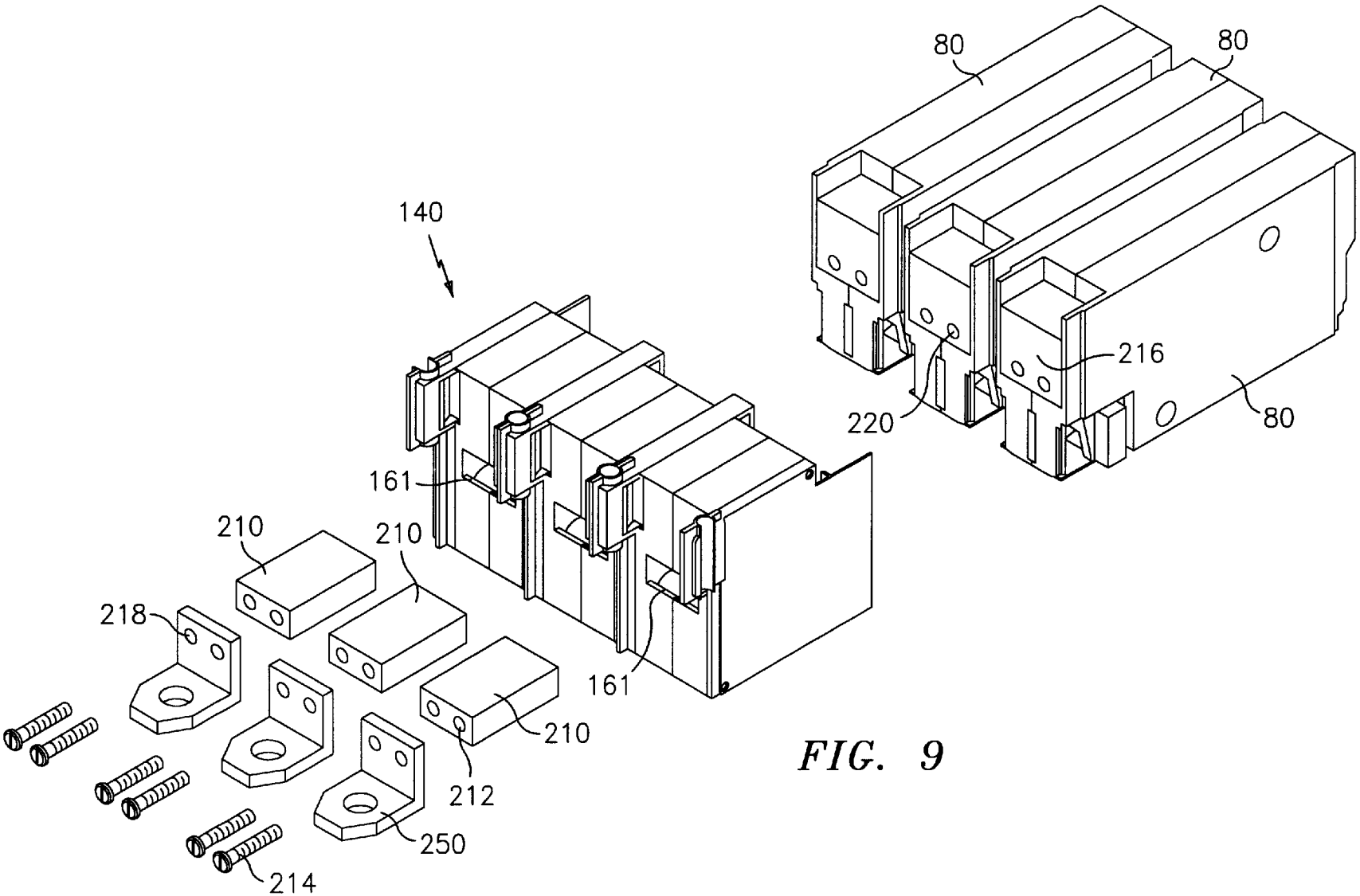
FIG. 9 is an exploded perspective view of a cassette assembly, current transformer assembly and load straps of the invention.

Referring to FIG. 9, a linearly partially exposed perspective view of the operable portions of the device 10 of the invention is illustrated. Three cassettes 80 are illustrated for a three pole circuit breaker. These are attachable to current transformer block 140 as described hereinbefore. Through each CT 142 are openings 161 for cores 210 which are preferably positioned between the two coils of the current transformer to pass the current that generates the magnetic field. The cores 210 are bored 212 so that load lugs 240 may be attached with screws 214 through screw holes 218 electrically to load straps 216 by threaded holes 220.

Figure 10:
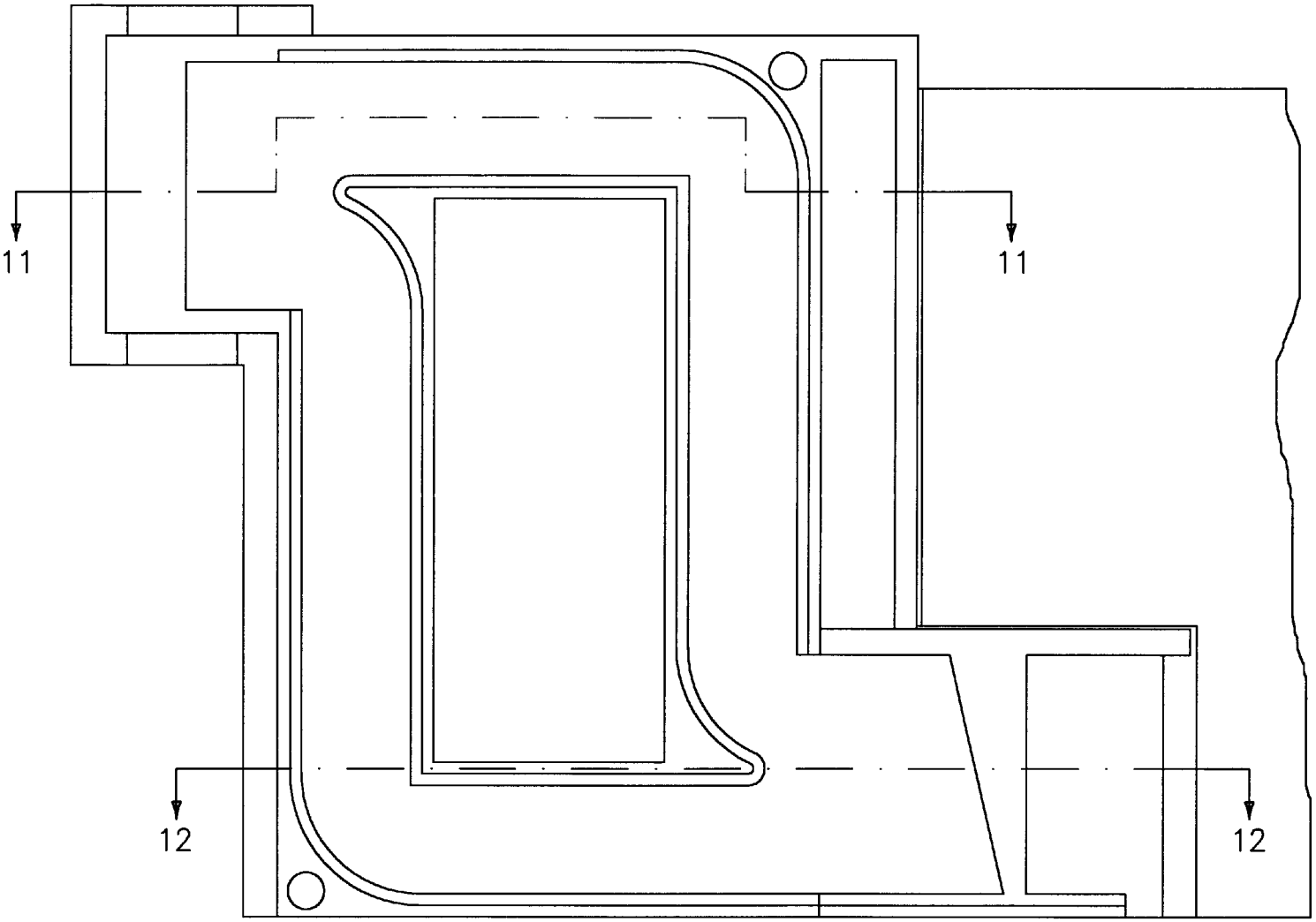
FIG. 10 is a side view of a vent channel with attached components.
Figure 11:
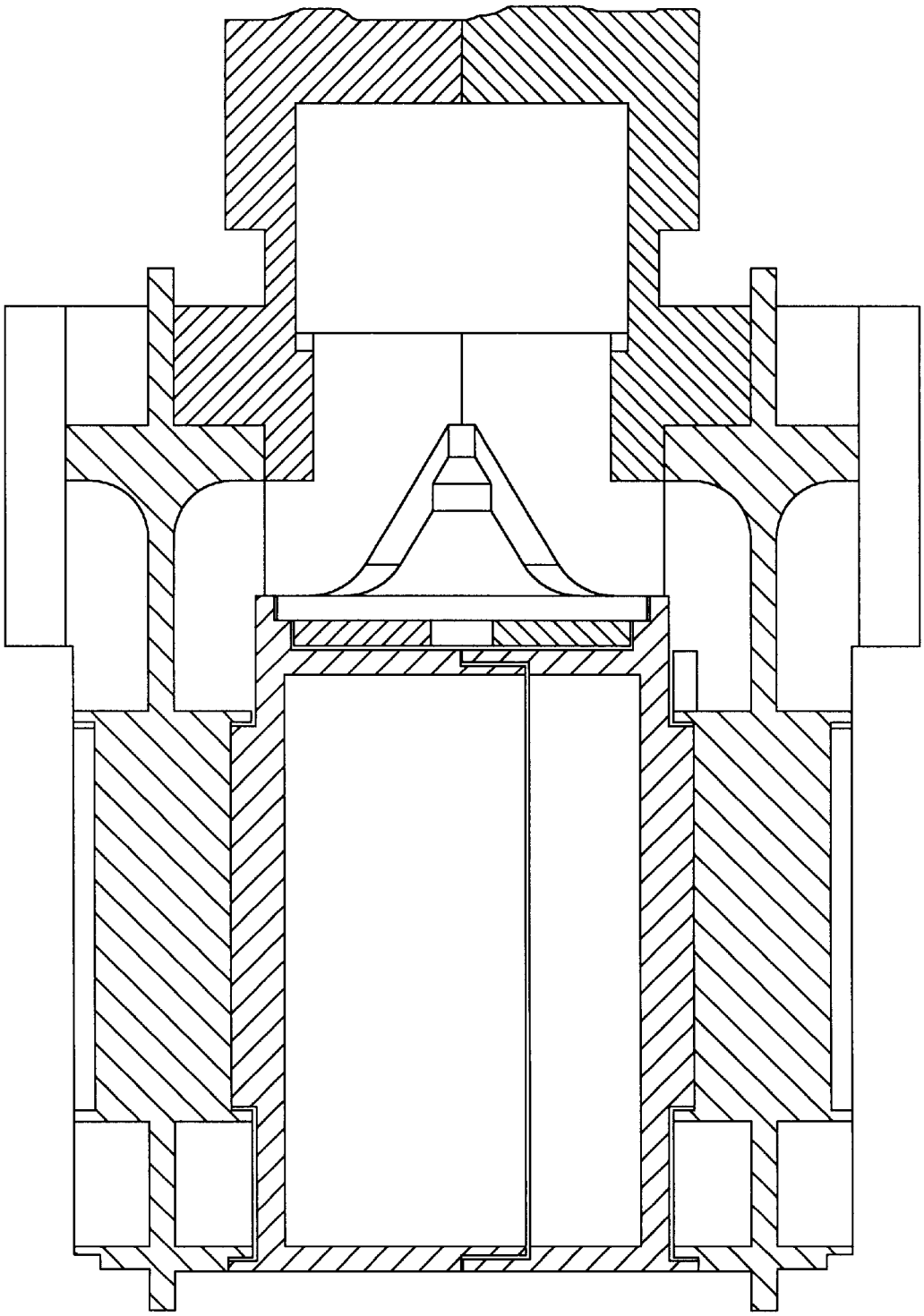
FIG. 11 is a cross section view of the components of FIG. 10 taken along section line 11—11.
Figure 12:
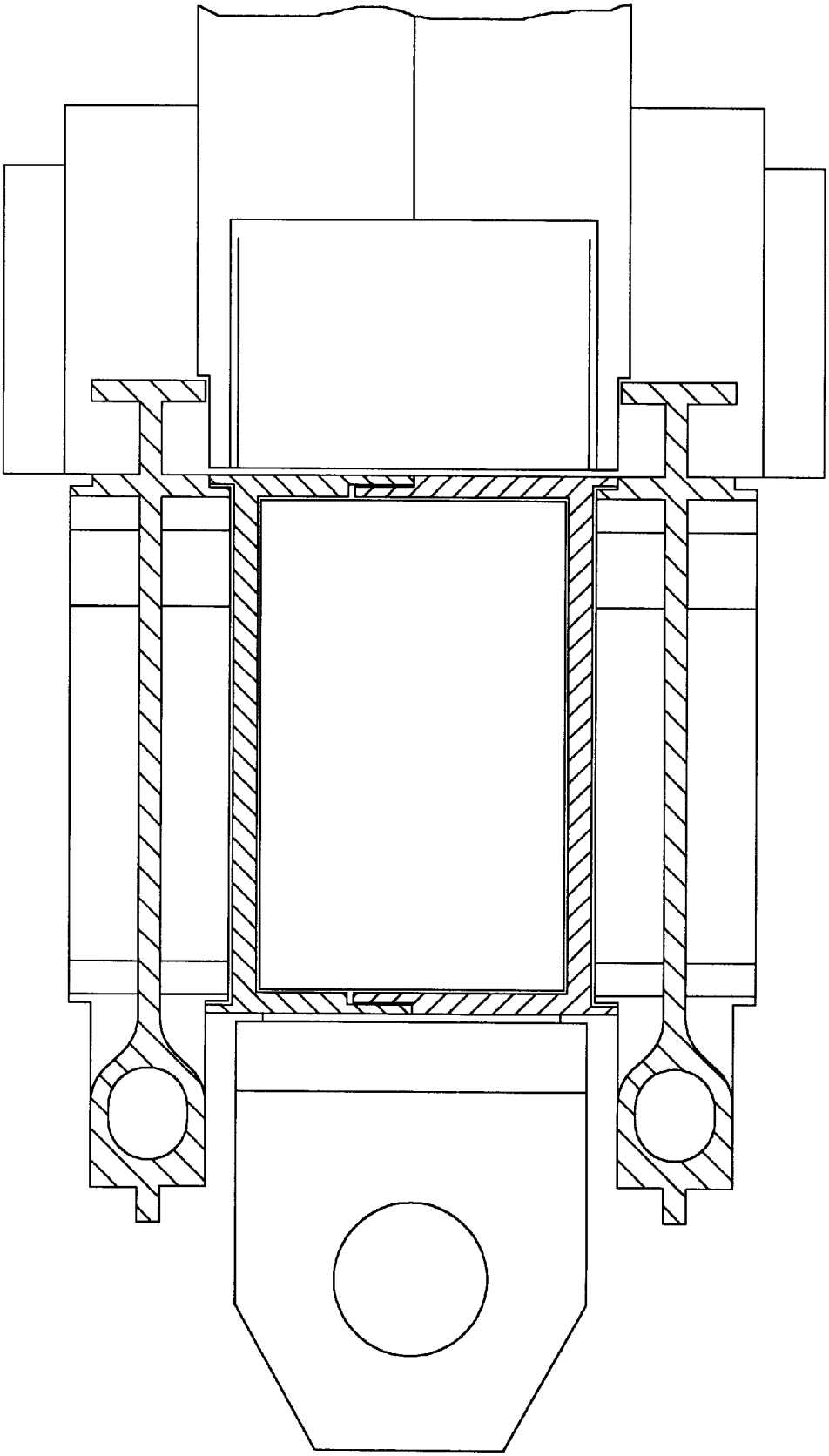
FIG. 12 is a cross section view of the components of FIG. 10 taken along section line 12—12.
Figure 13:
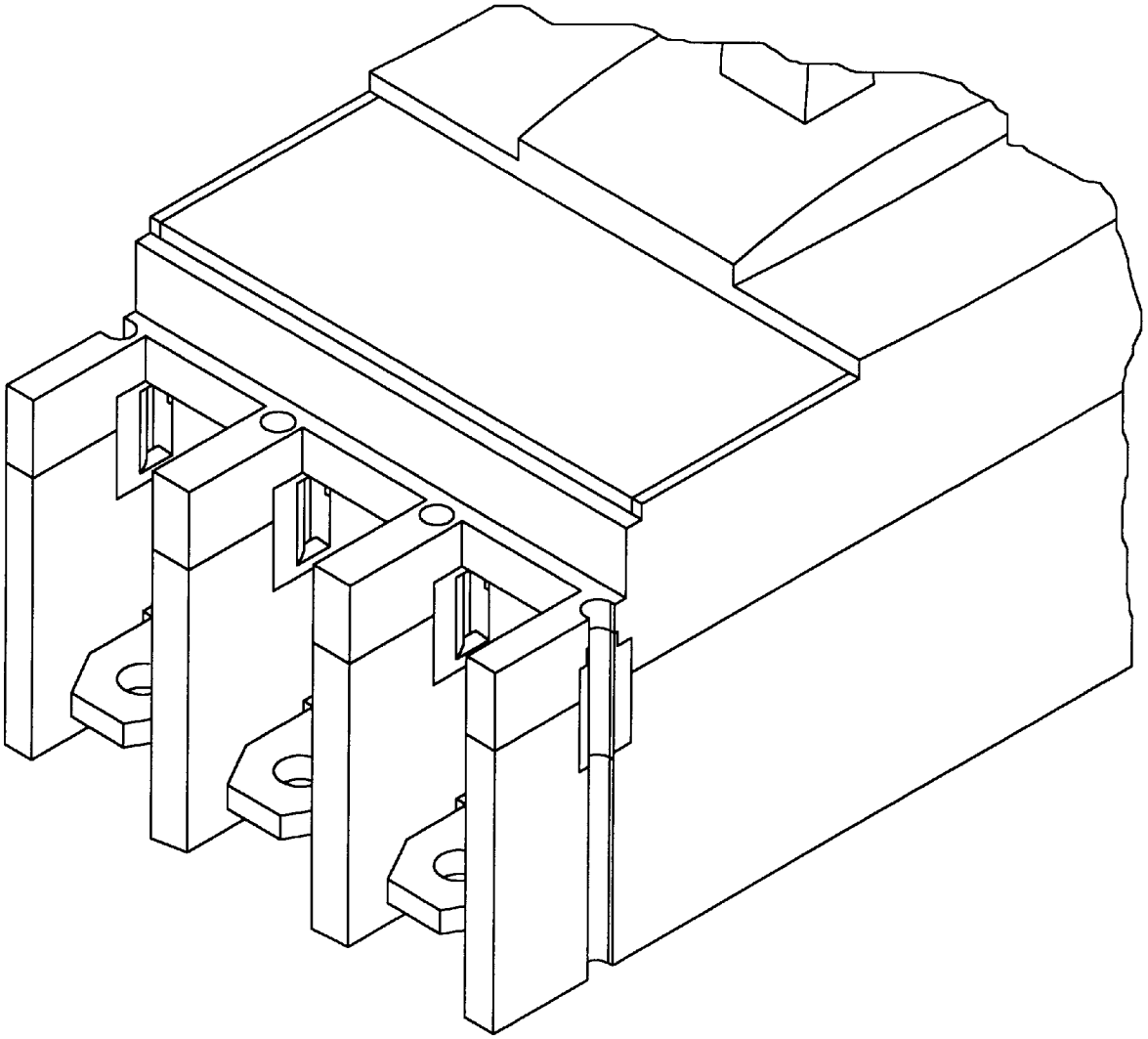
FIG. 13 is an enlarged view of the load end of the embodiment of FIG. 1 wherein mechanical interaction of several parts is illustrated.
Figure 14:
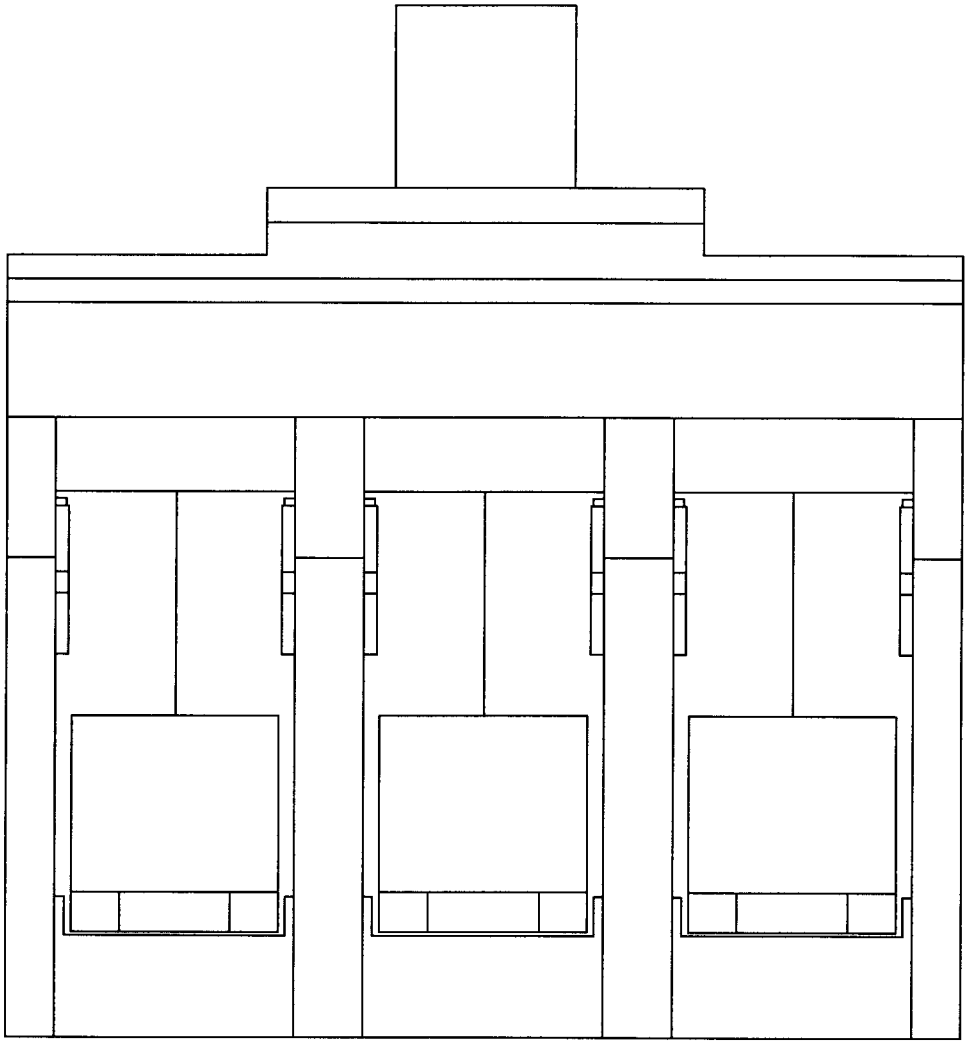
FIG. 14 is a load side elevation view of the first circuit breaker embodiment of the invention.
Figure 15:
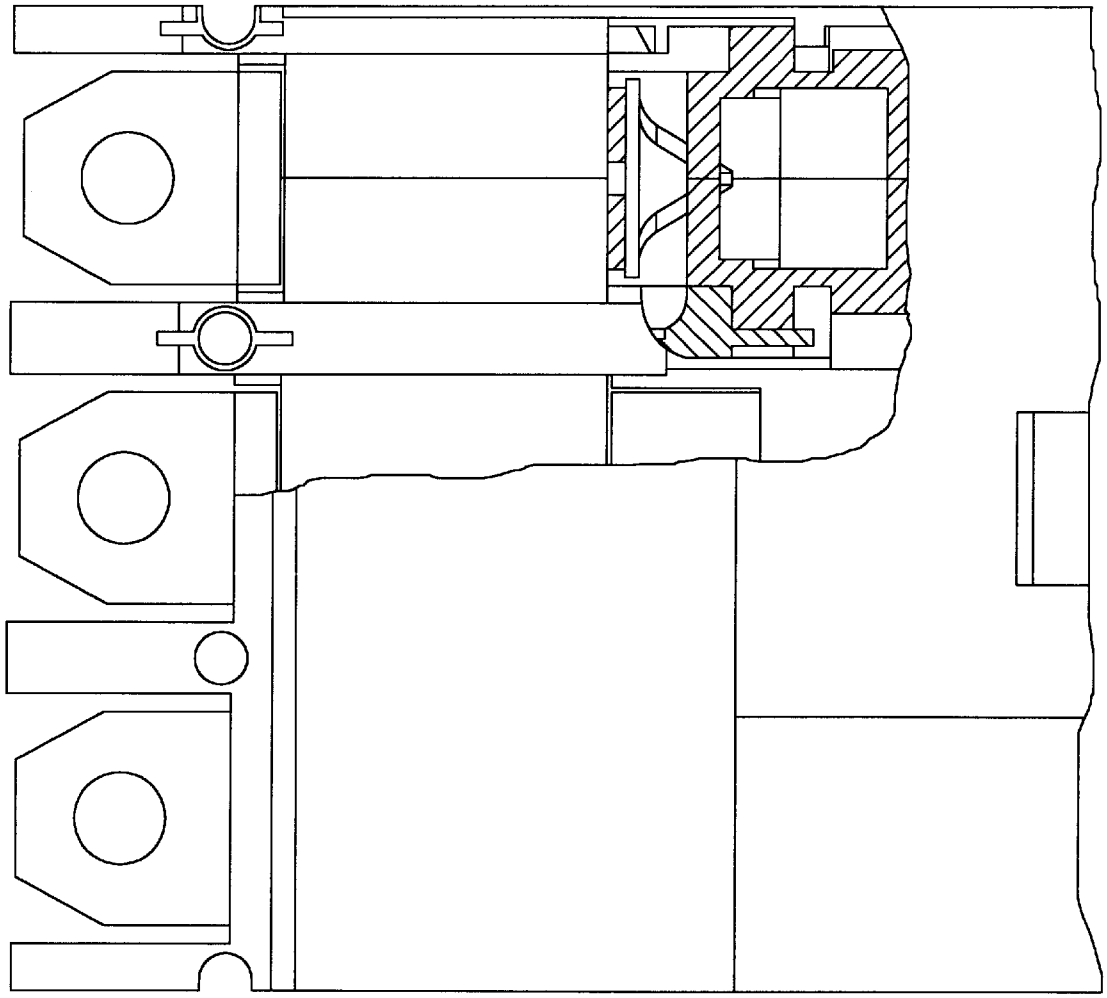
FIG. 15 is a partially broken away top plan view of the first embodiment of the invention.
Figure 16:
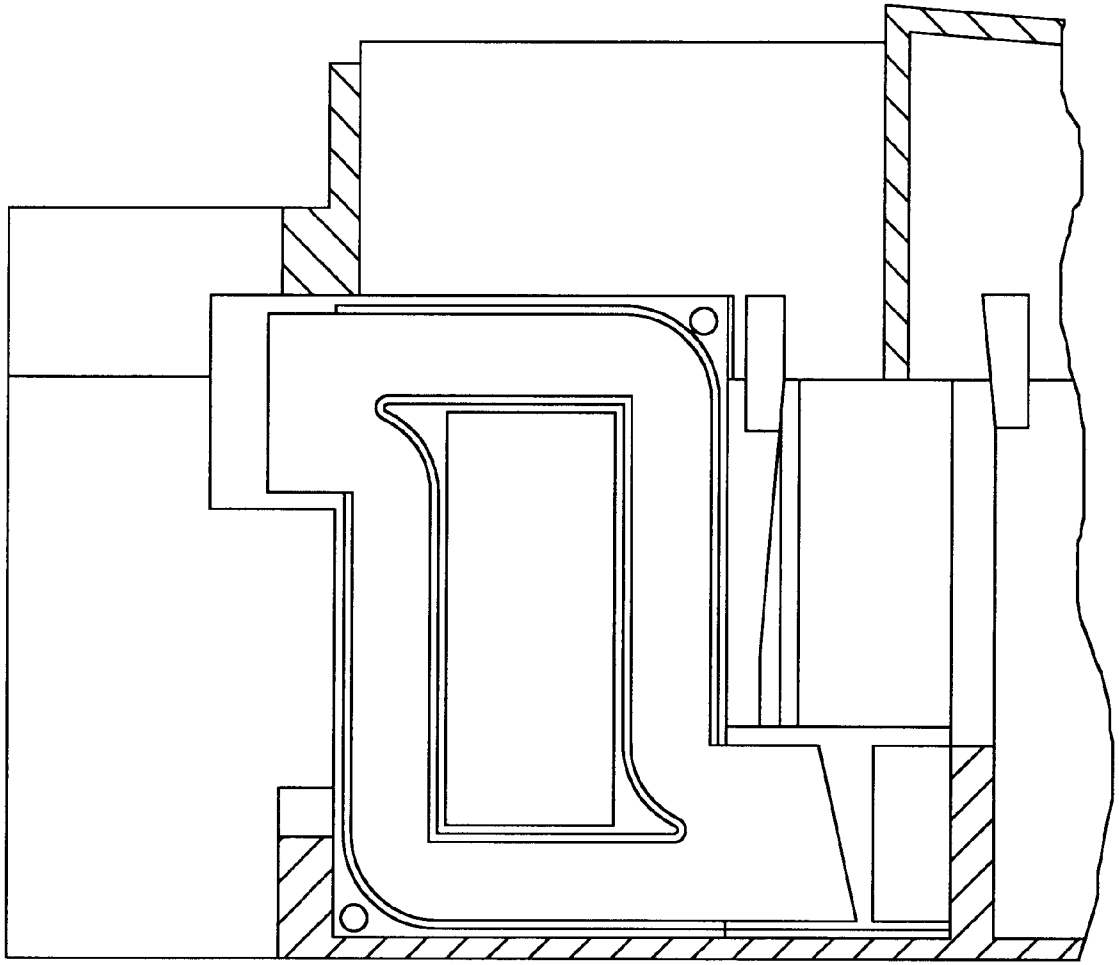
FIG. 16 is a partial cross section illustration of the circuit breaker of FIG. 15.
Figure 17:
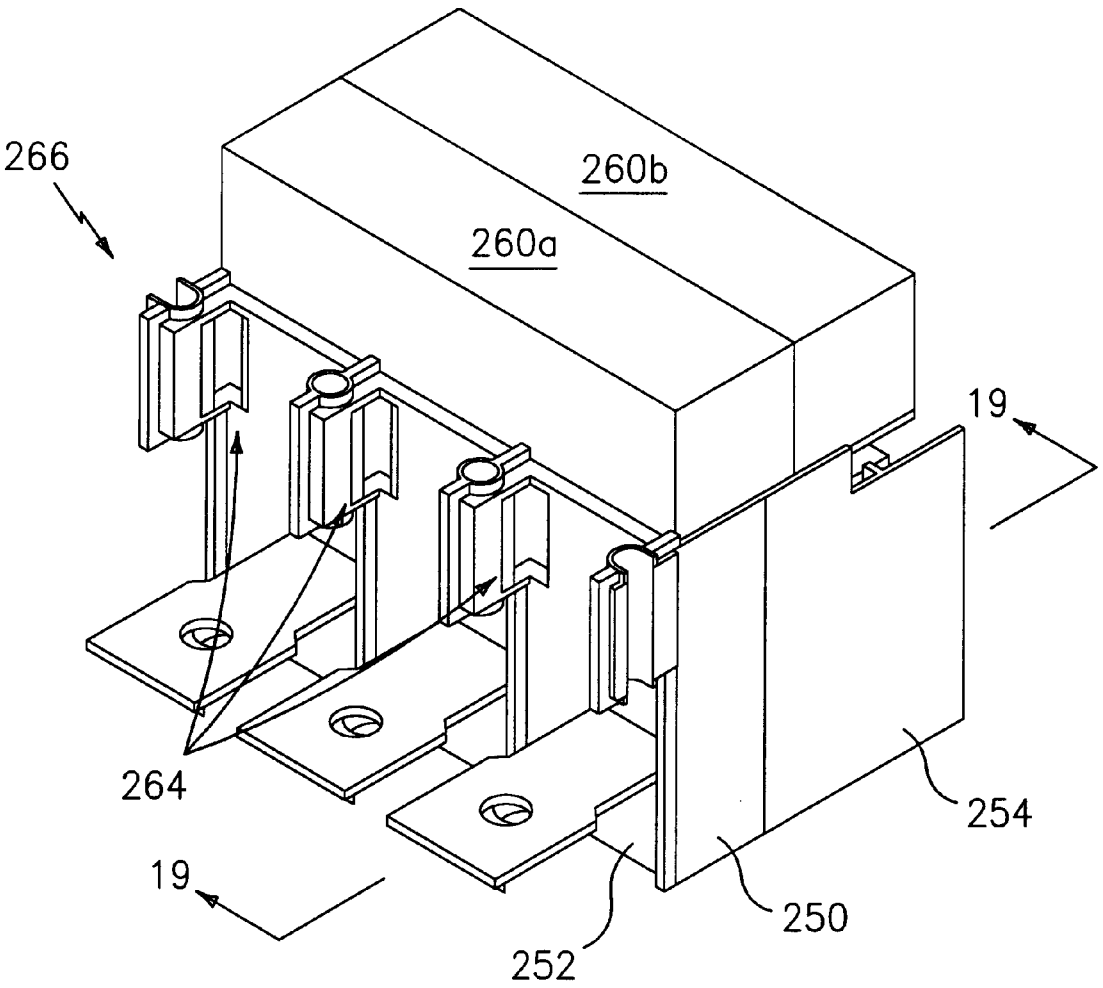
FIG. 17 is a perspective view of an alternative embodiment of the invention that employs the cassette as described above and a thermomag trip unit in place of the current transformer of the previous embodiment.

Referring to FIGS. 10–12, further understanding of the arrangement of the invention is provided. The figures represent a portion of a cassette attached to a current transformer complete with housing and two vent structures (one on each side of the current transformer housings).

Referring to FIGS. 17–20, a second embodiment of the invention is introduced by illustrating only those portions of the device which differ from the previous embodiment. More specifically, the cassette illustrated above is not shown here as it does not change in this embodiment. Rather only the thermomagnetic tripping unit and housing is illustrated here which provides a venting arrangement of the invention. The unifying premise of the invention i.e. exhausting exhaust gasses above the load strap, obtains.

Figure 18:
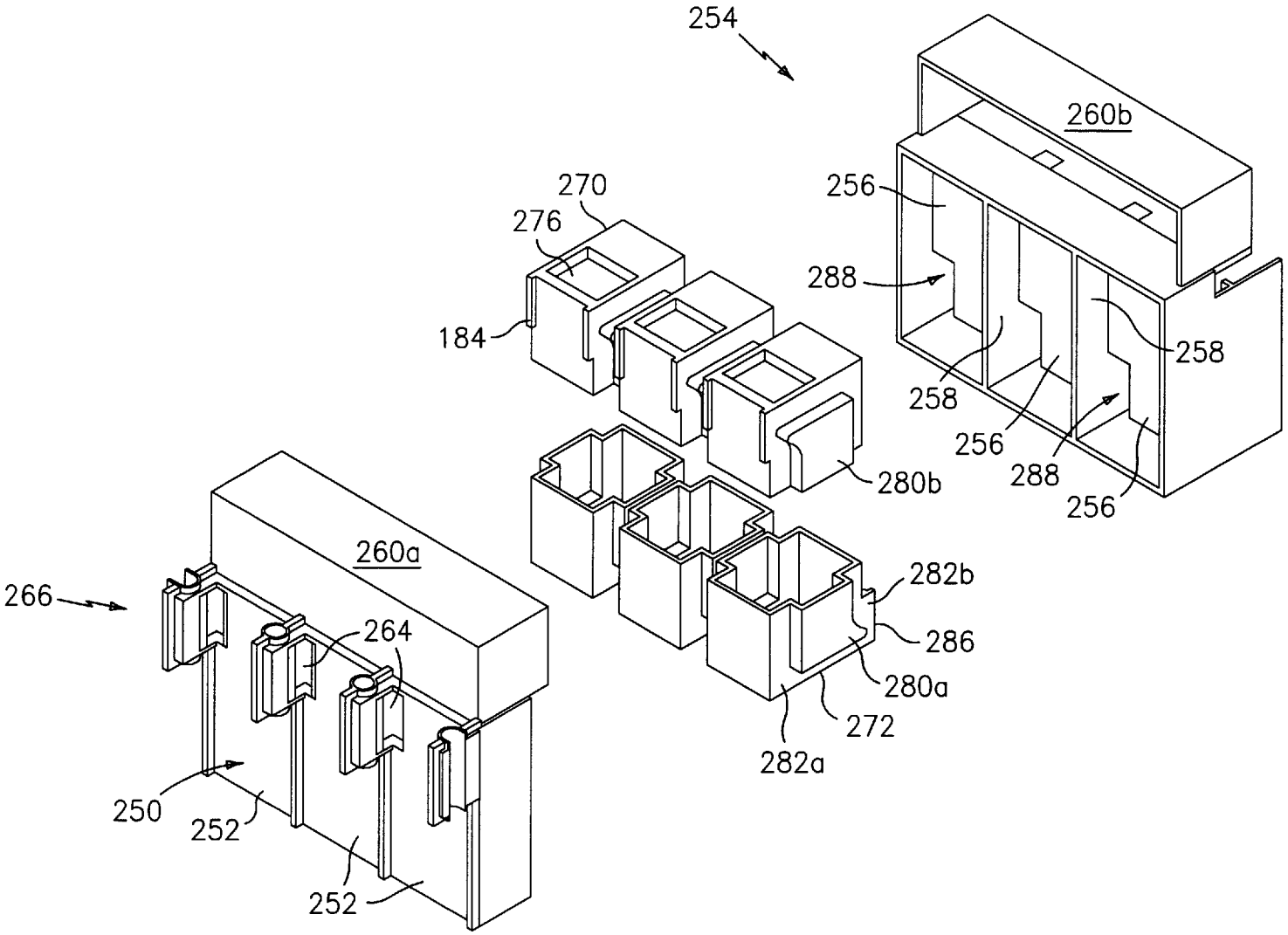
FIG. 18 is an exploded perspective view of the housing portions of the trip unit illustrated in FIG. 17.

In this embodiment, a front housing 250 having three compartments 252 (as shown; more or fewer are possible) is mateble with a rear housing 254 also having three compartments 256. Visible in FIG. 18 are compartment partitions 258 which are mirrored in front housing 250 and mate at the parting line between these two housings. This provides separation of gasses flowing from different phase circuits which is beneficial for reasons noted earlier. An upper chamber 260*a*/260*b* is also shown atop the front and rear housing.

Referring back to front housing 250, one having been exposed to the foregoing embodiment will recognize vent openings 264 in vent structure 266. The vent structure 266 functions as does vent structure 180 of the prior embodiment in all respects and therefore does not require separate explanation here.

Within the chambers formed by the unions of compartments 252 and 256 are upper bimetal housings 270 and lower bimetal housings 272. These housings together house the thermomag trip units of the device. Opening 276 in each upper housing allows portions of the thermomag unit 274 (FIG. 19) to extend through into chamber 266 where a mechanical trip is located. On the sides of the housings 270/272, a profile 280 is shown which causes a bifurcated channel 282*a* and 282*b* to be formed around profile 280. Profile 280 preferably contacts either an interior surface of an exterior wall of housing 250 or 254 or a surface of compartment partitions 258 depending upon location. Compartment partitions 258 make contact on both major surfaces with adjacent bimetal housing profiles 280. The surface with which profile 280 makes contact, functions as a wall of the channel 282*a* or 282*b*.

At the top of upper bimetal housing 270 are vent opening seals 284 which both properly locate the bimetal housing in the front housing 250 and help prevent gas mixing within front housing 250.

At the rear of lower bimetal housing 272 a vent channel seal 286 is provided and is to be received in vent channel inlet 288. Seal 286 includes notch 287 to provide a good overlapped seal to the cassette. Inlet 288 receives exhaust gas from the cassette which is not shown in the drawings of this embodiment but will be understood by one of ordinary skill in the art from the drawings in the foregoing embodiment.

Chamber 260 houses a standard circuit breaker trip unit mechanism 290 (FIG. 19) that does not produce exhaust gasses. The trip units described in U.S. Pat. Nos. 5,392,016; 5,381,120; 5,121,092; and 5,146,195 (the entire contents of all of which are incorporated herein by reference) are similar to the type illustrated herein.

In another embodiment of the invention, referring to FIGS. 21–24, venting of the load side 300 of the cassette 302 is accomplished by providing a scallop 304 having a generally L-shaped configuration which conveys exhaust gasses from the load side to the line side of the cassette. The scallop 304 in cassette 302 represents a portion of an exhaust flow channel which can be viewed in section in a completed form in FIG. 22. The channel is identified as 308. Channel 308 is completed by partition walls 310 from midcover 312 meeting partition walls 314 from base 316. Walls 310 and 312 meet in abutting relationship at 318.

Figure 21:
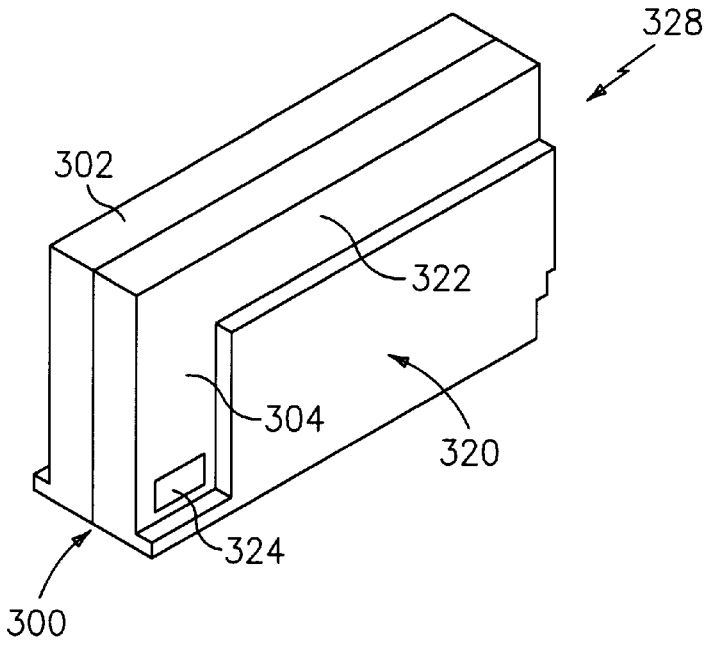
FIG. 21 is a perspective view of another cassette embodiment of the invention.
Figure 22:
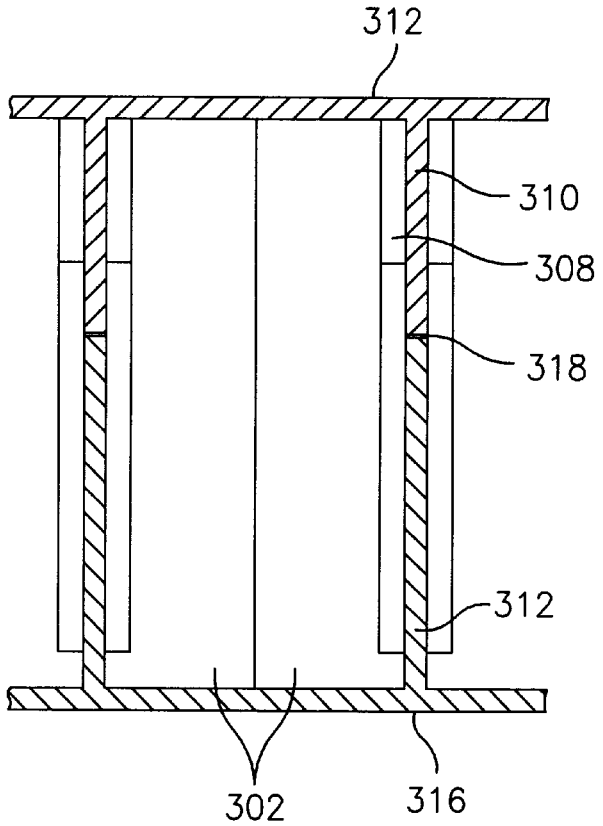
FIG. 22 is a cross section view of the cassette of FIG. 21 in a complementary housing.

Referring to FIG. 21, surface 320 acts as a spacer from partition walls 310, 312 and thus causes the walls not to meet surface 322 which forms the side of scallop 304. Scallop 304 extends to the line side 328 of cassette 302 and communicates preferably directly with exhaust opening 324. When the midcover 312 and base 316 are assembled around the cassettes 302, a cross section view provides the view of FIG. 22.

Figure 23:
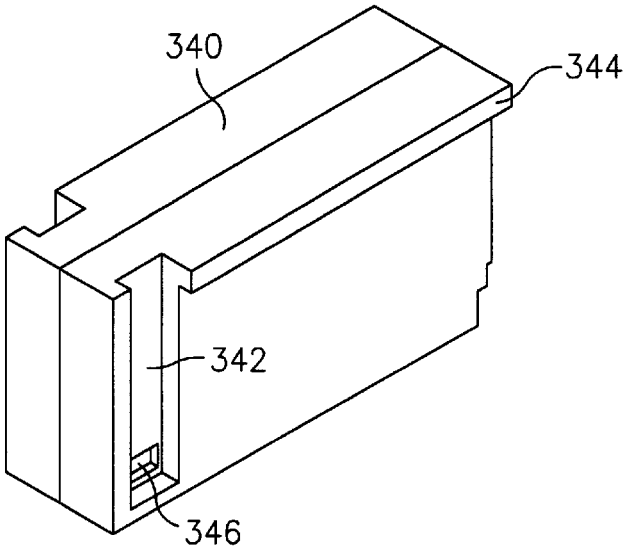
FIG. 23 is a perspective view of another cassette embodiment of the invention.
Figure 24:
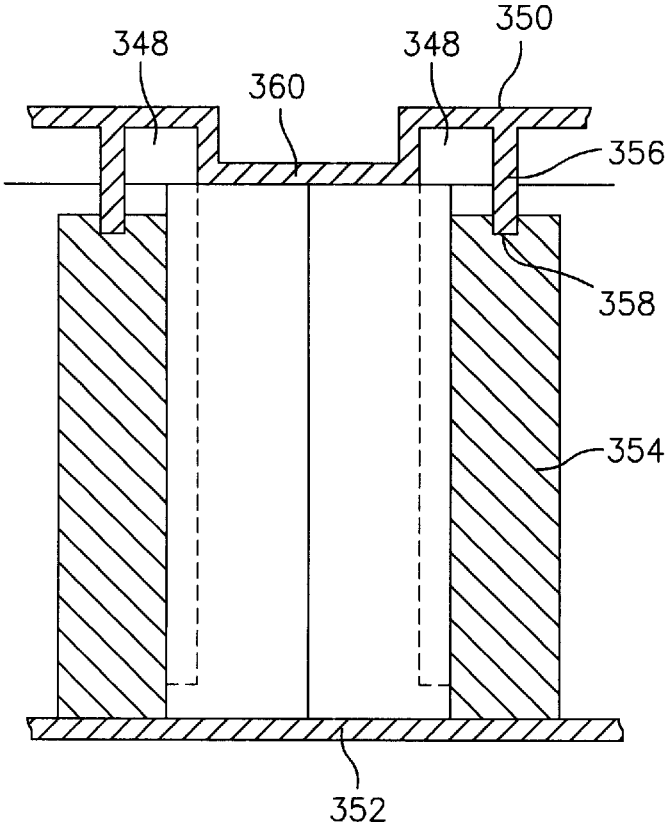
FIG. 24 is a cross section view of the cassette of FIG. 23 in a complementary housing.

Another sub embodiment of line side exhausting of load side gasses is in FIGS. 23 and 24. Differences of construction are evident in each component but the result achieved, line side exhaust, is retained. Referring to FIG. 23, cassette 340 includes vent chimney 342 and overhang 344 on both sides thereof. The chimney 342 is in fluid communication with exhaust opening 346 and provides a directly upward path for exhaust gas to travel toward midcover channel 348. Overhang 344 is provided to form the floor of the channel 348. Base 352 is attached to spacers 354 in any of a number of known ways. Midcover 350 preferably includes spacer mates 356 which are received in groove 358 in spacer 354. Spacer mates 356 are thin in cross section to provide a larger midcover channel 348. Another feature of midcover 350 is channel separator 360 which preferably rests atop cassette 340 when midcover 350 is assembled with base 352. In the assembled condition, chimney 342 intersects midcover channel 348 at about 90°. Midcover channel 348 leads to an exhaust vent (not shown) at the line side of the cassette.

Figure 26:
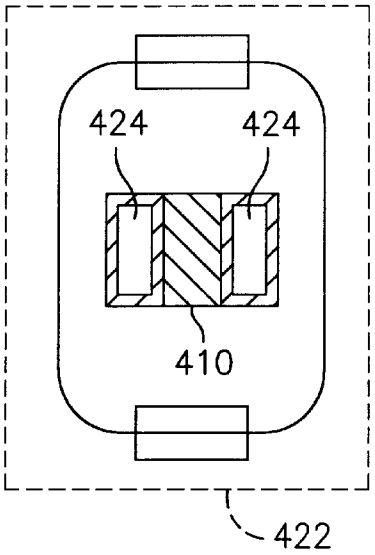
FIG. 26 is a cross section view of an embodiment invention taken along section line 26—26 in FIG. 25.

In yet another embodiment of the invention, the load side exhaust gasses are vented directly through the center of the current transformer. The current transformers are of the type described previously herein but preferably provide more space between the coils to allow for the slightly larger agglomeration of parts than simply the load terminal strap as illustrated in FIG. 26.

Figure 25:
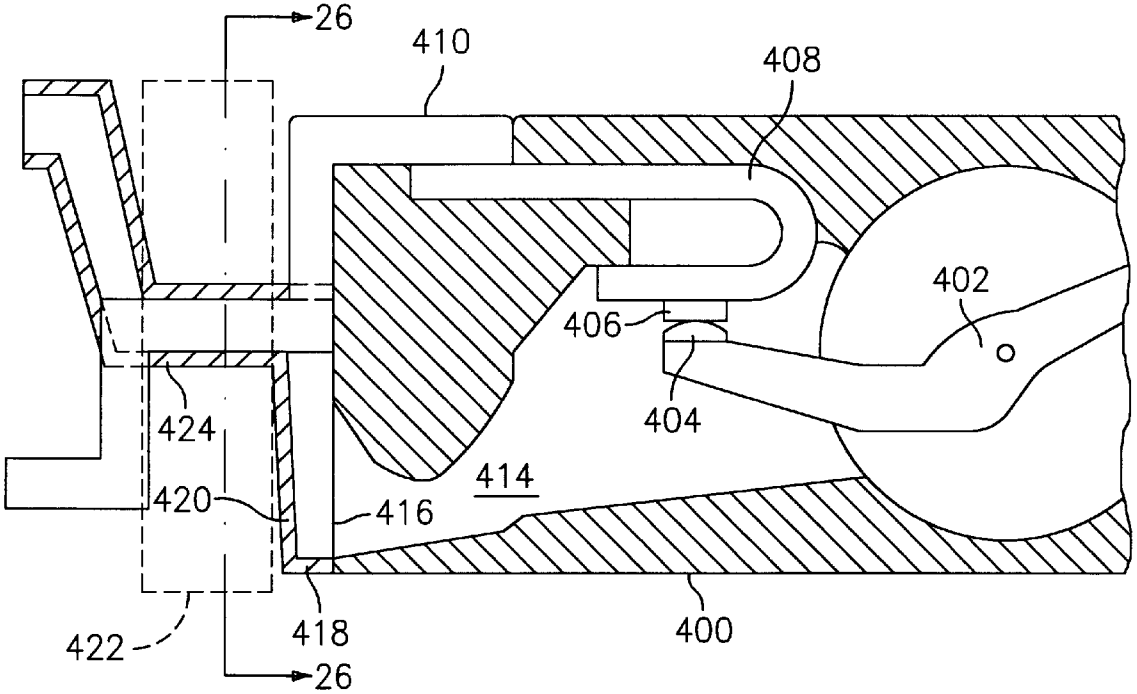
FIG. 25 is a schematic cross section of another cassette and current transformer arrangement of the invention.

Referring to FIG. 25, a cross section of the rotary break circuit breaker cassette 400 is illustrated schematically with a rotor 402 contacts 404 and 406, load strap 408 and load terminal strap 410 shown. Also shown is an exhaust gas area 414 and a port 416. As will be understood the cassette 400 is generally conventional and it is the current transformer housing and vent channels that provides the inventive venting arrangement.

Vent channel 418, a part of the CT housing, extends from the port 416 outwardly from cassette 400 and then steeply upward in vent riser 420. Vent riser 420 is located on both sides of the cassette so that the vent path will extend around both sides of the load terminal strap 410 in the current transformer 422 so that conduit volumetric capacity is not reduced. Upon exit from the area between coils of transformer 422, two individual exit risers 430 extend upwardly and to a first opening in the CT housing (not shown) similar to the foregoing CT housing embodiments. As riser 420 reaches the mid height of current transformer 422 it hits vent-through-channels 424 and is directed through the coils of a current transformer 422. As can be seen in FIG. 26, vent-through-channels 424 are closely adjacently placed with load terminal strap 410 in the sensor of the current transformer 422.

In yet another embodiment of the invention, referring to FIGS. 27–30, cassette 500 is constructed differently to stagger the cassette load side openings 502 and 504. The purpose of stagging these openings is to provide a larger vent channel. The vent channel does not need to be split in half, as in the first embodiment, to handle gasses from adjacent cassettes. Rather, since the openings are staggered the gas channels can be full width between adjacent current transformer housings.

Figure 27:
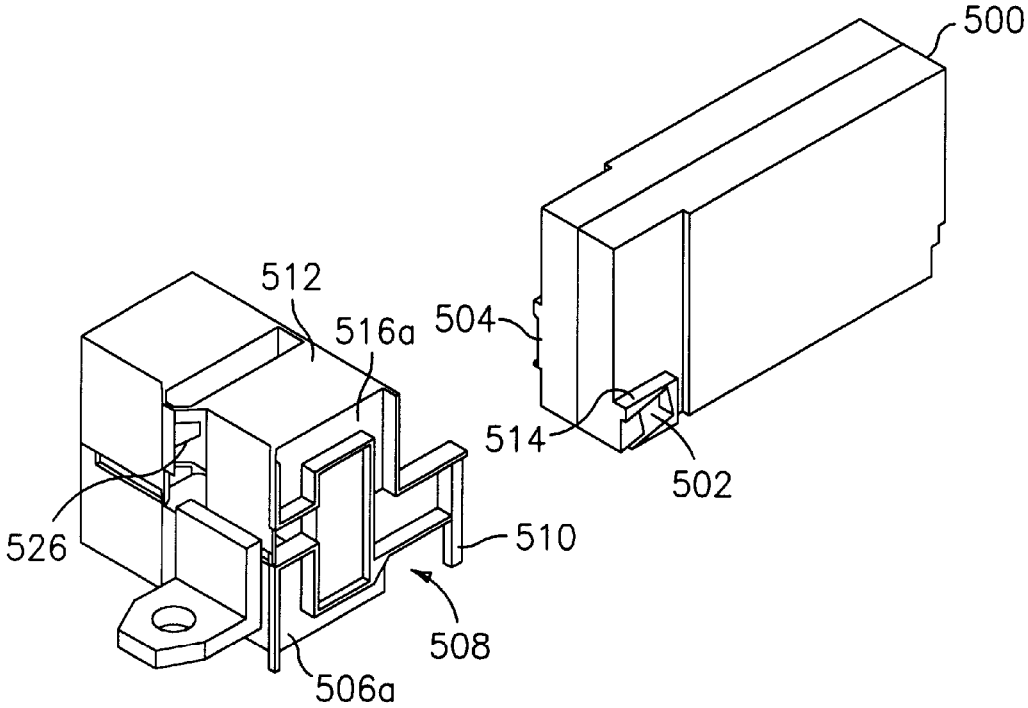
FIG. 27 is a perspective exploded view of another cassette and CT housing of the invention.
Figure 28:
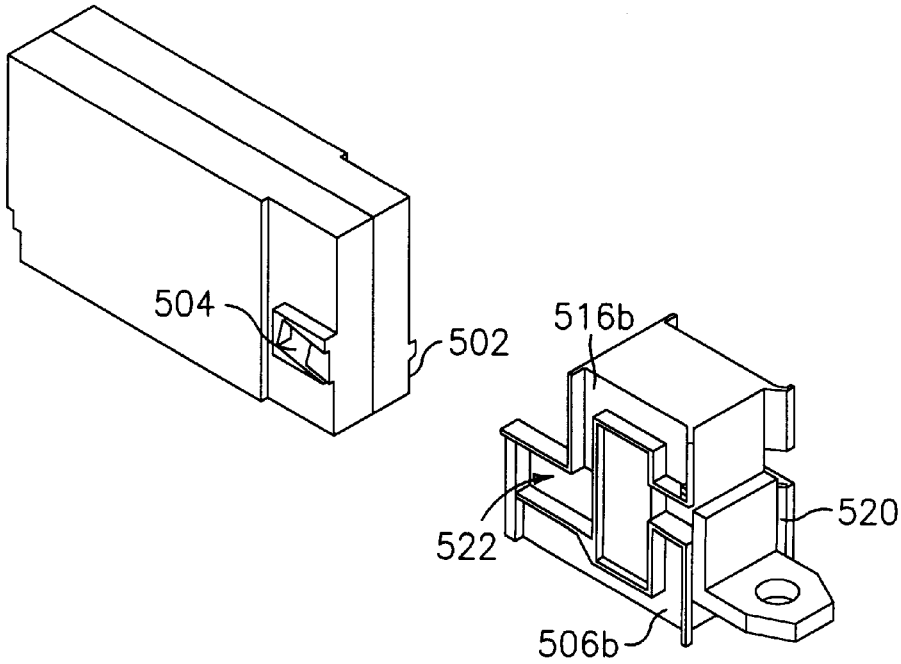
FIG. 28 is a perspective view of the parts illustrated in FIG. 27 but 90° turned.

In FIG. 27, opening 502 will communicate with channel 506 through channel inlet 508. It should be noted that extension 510, when CT housing 512 is connected to cassette 500, extends downwardly behind boss 514 of opening 502. Gasses conducted through channel 506 are vented from a vent 520 which can only be viewed in FIG. 28. The upper channel 516 is used by an adjacent cassette through an opening 504, reference being made to FIG. 28. Arrow 522 points to an opening in CT housing 512 such that channel **516*b*/516*a* (when assembled) will receive the gasses emitted from opening 504. Channel 506*a*/506*b* (assembled) receive the gasses from opening 502. Referring back to the channel of 516*a*/516*b*, the exit vent 526 is visible in FIG. 27**.

Figure 19:
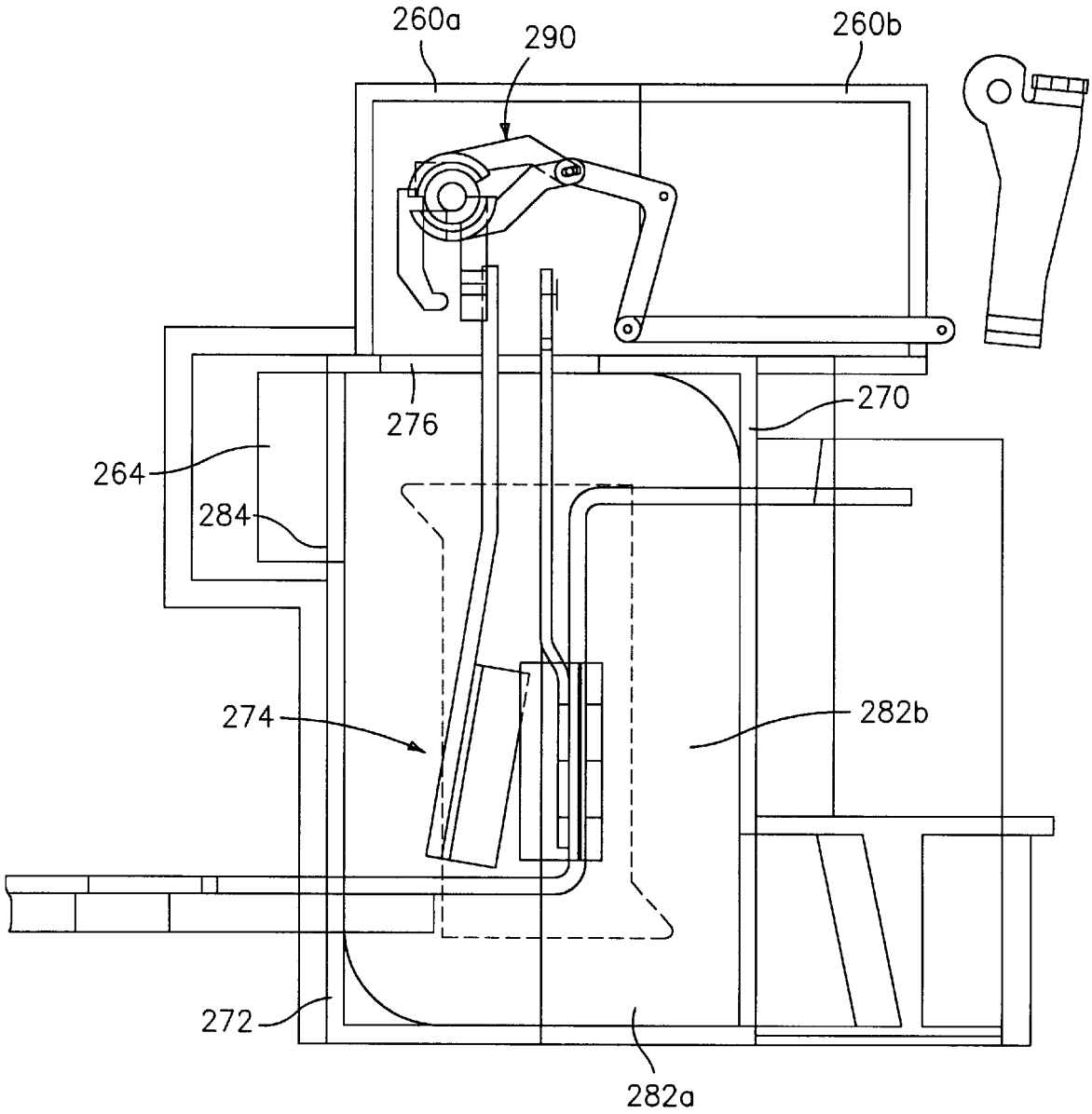
FIG. 19 is a cross section view of the trip unit taken along section line 19—19 in FIG. 17.
Figure 20:
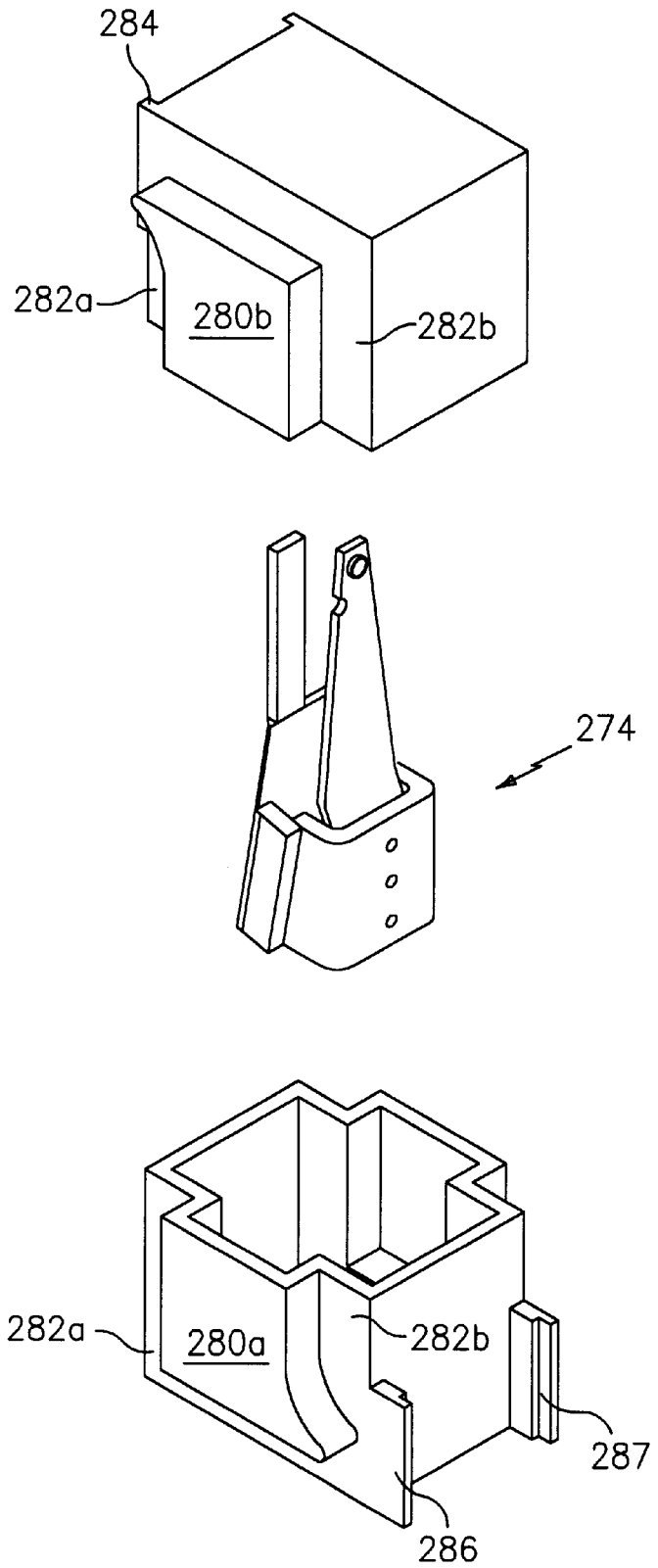
FIG. 20 is an exploded perspective view of the thermomag tripper and its housing.
Figure 29:
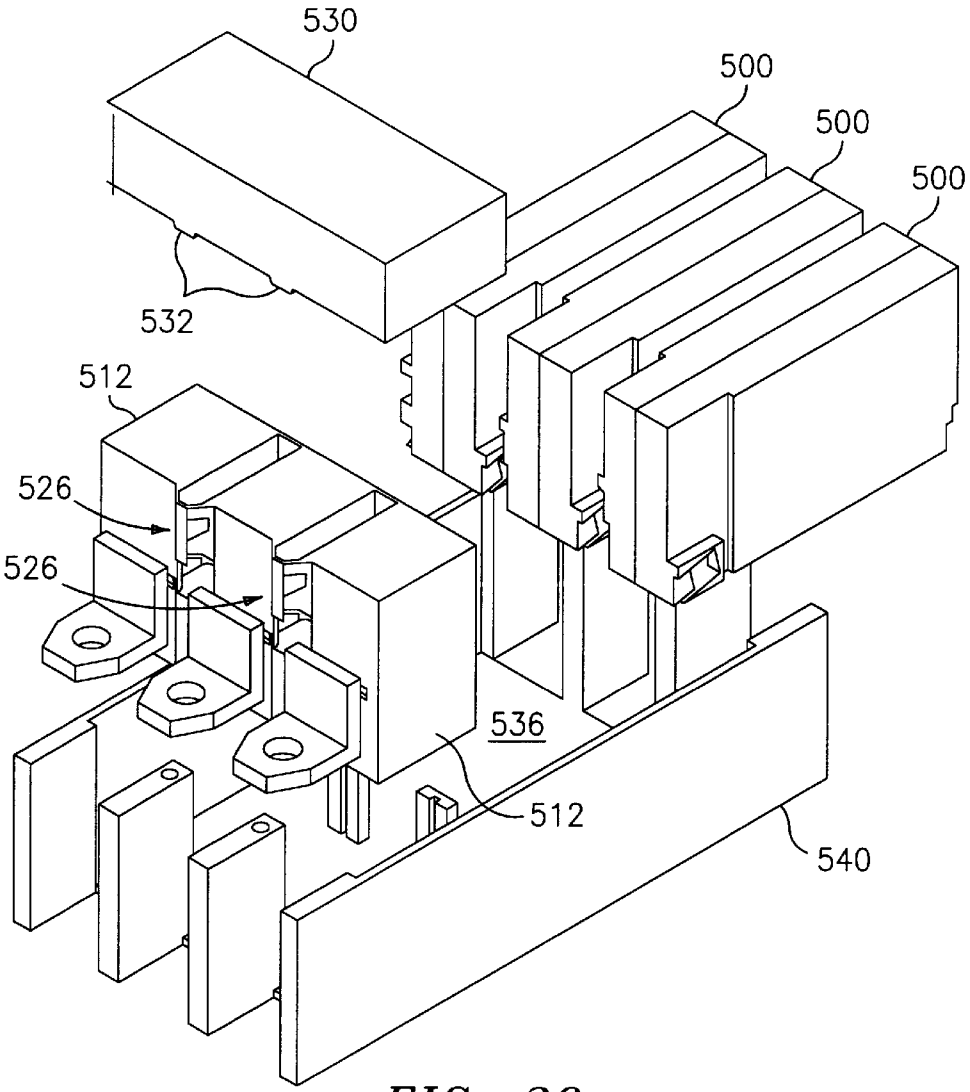
FIG. 29 is an exploded perspective view of this embodiment of the invention with all internal subassemblies shown.
Figure 30:
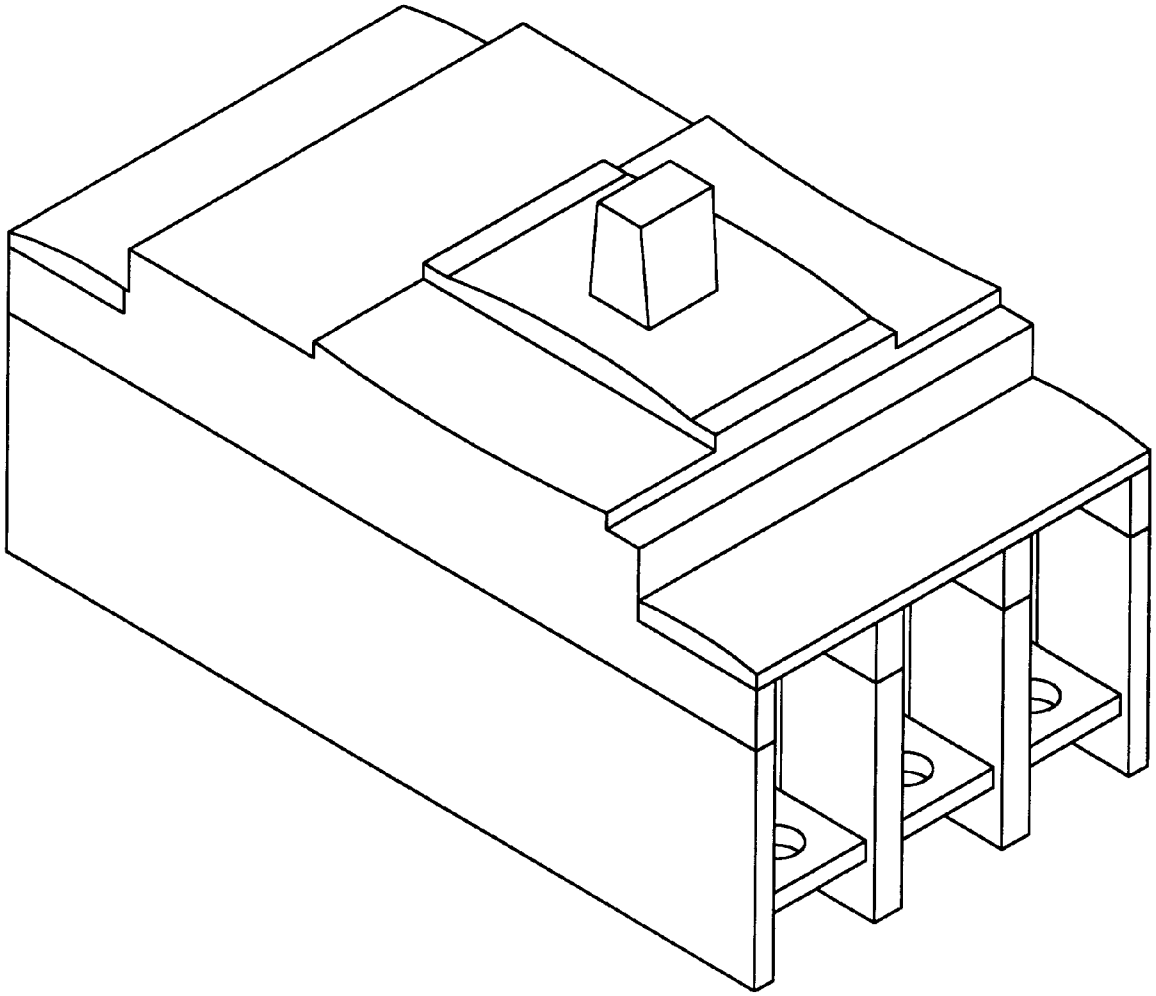
FIG. 30 is an assembled view of this embodiment.

Referring to FIG. 29, an exploded view of the invention with several cassettes 500 side-by-side and CT housings 512 likewise side-by-side from the above discussion and thus figure those of skill in the art will understand the invention. FIG. 19 is also important to introduce additional elements necessary to form channels **516*a*/516*b* and 506*a*/506*b*. An electronic trip unit 530 is mounted atop a bank of CT housings 512 and includes rib structures 532 which are nested in the open top of each channel 516*a*/516*b* to seal the same. The bottom of channel 506*a*/506*b* is interior surface 536 of base 540**. With respect to other features of the base and contacts illustrated, one of ordinary skill in the art will easily identify the same based upon the foregoing discussion with respect to other embodiments of the invention.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A circuit breaker including a breaker cassette having a load strap and a line strap and a line exhaust gas route above the line strap and a load gas route beneath the load strap, the improvement comprising:

a current transformer housing containing a current transformer and matable to said cassette with an exhaust gas inlet in fluid communication with said load gas route, said housing providing a fluid path to an exhaust vent above said load strap.

2. A circuit breaker including a breaker cassette as claimed in claim 1 wherein said fluid path is adjacent to said current transformer.

3. A circuit breaker including a breaker cassette as claimed in claim 1 wherein said fluid path is through said current transformer.

4. A circuit breaker having at least one breaker cassette with an interruption exhaust gas outlet below a load strap thereof comprising:

a trip unit housing connectable to said at least one cassette;

a gas flow path in said trip unit housing in fluid connection with said gas outlet in said at least one cassette;

a gas vent in fluid communication with said flow path in said trip unit housing, said vent being located above said load strap.

5. A circuit breaker having at least one breaker cassette as claimed in claim 4 wherein said trip unit is a current transformer and said flow path is around said current transformer.

6. A circuit breaker having at least one breaker cassette as claimed in claim 4 wherein said trip unit is a thermomagnetic unit.

7. A circuit breaker having at least one breaker cassette as claimed in claim 4 wherein said trip unit is a current transformer and said flow path is through said current transformer.

8. A circuit breaker having at least one breaker cassette as claimed in claim 5 wherein said flow path is defined by an exterior surface of said trip unit housing and a vent structure mated therewith.

9. A circuit breaker having at least one breaker cassette as claimed in claim 8 wherein said vent structure includes profiled surfaces on both major surfaces, such that adjacent trip unit housings also form flow paths and the paths created are independent.

10. A circuit breaker having at least one breaker cassette as claimed in claim 8 wherein said flow path is bifurcated providing two flow paths to maximize flow volume.

11. A circuit breaker having at least one breaker cassette with an interruption exhaust gas outlet below a load strap thereof comprising:

a flow channel provided in said cassette and extending to a line side thereof to communicate with a vent opening;

a breaker housing having at least one partition wall therein which is complementary to said cassette and transforms said flow channel into a flow conduit.

12. A circuit breaker having at least one breaker cassette as claimed in claim 9 wherein said cassette includes two load ride exhaust gas openings which are staggered in height and said vent structure provides flow paths in staggered relationship whereby full width flow paths are maintained.

* * * * *

UNITED STATES PATENT AND TRADEMARK OFFICE

CERTIFICATE OF CORRECTION

PATENT NO. : 6,037,555
DATED : March 14, 2000
INVENTOR(S) : Castonguay et al.

It is certified that error appears in the above-identified patent and that said Letters Patent is hereby corrected as shown below:

Title page,
Item [75], Inventors, after "both of Conn." insert -- Bhaskar Ramakrishnan, Lousiville, Kentucky --

Item [56], References Cited, FOREIGN PATENT DOCUMENTS, after "0 295 155 12/1988 European Pat. Off." delete "0 95 158" and insert therefor -- 0 295 158 --

Signed and Sealed this

Third Day of December, 2002

JAMES E. ROGAN
*Director of the United States Patent and Trademark Office*